US010880960B2

(12) United States Patent
Yoshino et al.

(10) Patent No.: US 10,880,960 B2
(45) Date of Patent: Dec. 29, 2020

(54) MICROWAVE HEATING DEVICE

(71) Applicant: Panasonic Corporation, Osaka (JP)

(72) Inventors: Koji Yoshino, Shiga (JP); Yoshiharu Oomori, Shiga (JP); Masafumi Sadahira, Shiga (JP); Masayuki Kubo, Shiga (JP); Osamu Hashimoto, Kanagawa (JP); Ryosuke Suga, Kanagawa (JP)

(73) Assignee: Panasonic Corporation, Osaka (JP)

( * ) Notice: Subject to any disclaimer, the term of this patent is extended or adjusted under 35 U.S.C. 154(b) by 241 days.

(21) Appl. No.: 16/072,237

(22) PCT Filed: Feb. 10, 2017

(86) PCT No.: PCT/JP2017/004862
§ 371 (c)(1),
(2) Date: Jul. 24, 2018

(87) PCT Pub. No.: WO2017/141826
PCT Pub. Date: Aug. 24, 2017

(65) Prior Publication Data

US 2019/0037653 A1 Jan. 31, 2019

(30) Foreign Application Priority Data

Feb. 17, 2016 (JP) ..... 2016-027505
Jan. 10, 2017 (JP) ..... 2017-001555

(51) Int. Cl.
*H05B 6/74* (2006.01)
*H05B 6/64* (2006.01)
(Continued)

(52) U.S. Cl.
CPC ..... *H05B 6/74* (2013.01); *F24C 7/02* (2013.01); *H05B 6/6402* (2013.01); *H05B 6/68* (2013.01); *H05B 6/705* (2013.01); *H05B 6/72* (2013.01)

(58) Field of Classification Search
CPC . H05B 6/68; H05B 6/705; H05B 6/72; H05B 6/74; H05B 6/6402; F24C 7/02
(Continued)

(56) References Cited

U.S. PATENT DOCUMENTS 3,845,267 A 10/1974 Fitzmayer
6,469,286 B1 10/2002 Nobue et al.
(Continued)

FOREIGN PATENT DOCUMENTS

CN 1144506 3/2004
CN 1177513 11/2004
(Continued)

OTHER PUBLICATIONS

JP2004071522 Translation, Electromagnetic Wave Reflection and High-Frequency Dielectric Heating Device Using It, Mar. 4, 2004, ProQuest (Year: 2004).*
(Continued)

*Primary Examiner* — Quang T Van
(74) *Attorney, Agent, or Firm* — Wenderoth, Lind & Ponack, L.L.P.

(57) ABSTRACT

There are provided heating chamber, and reflection angle control device provided on upper wall configuring at least part of walls of heating chamber and configured to control a reflection angle of a microwave to control standing wave distribution in heating chamber. Reflection angle control device controls the reflection angle of the microwave when the microwave radiated from microwave radiation device is not directly absorbed into heating target but is reflected by
(Continued)

the wall. Standing wave distribution in heating chamber can thus be controlled to be different from ordinary distribution for improvement in local heating performance.

6 Claims, 25 Drawing Sheets

(51) Int. Cl.

| | |
|---|---|
| ***H01Q 19/00*** | (2006.01) |
| ***H05B 6/70*** | (2006.01) |
| ***F24C 7/02*** | (2006.01) |
| ***H05B 6/68*** | (2006.01) |
| ***H05B 6/72*** | (2006.01) |

(58) Field of Classification Search
USPC ..... 219/678, 696, 708, 750, 748, 745, 746, 219/747, 756, 728; 118/725; 333/227; 343/910, 914, 700 R
See application file for complete search history.

(56) References Cited

U.S. PATENT DOCUMENTS

2003/0136779 A1* 7/2003 Lee ..... H05B 6/704 219/745
2013/0213956 A1* 8/2013 Sorin ..... H05B 6/6402 219/756

FOREIGN PATENT DOCUMENTS

| | | |
|---|---|---|
| EP | 1 096 833 | 5/2001 |
| JP | 2004-071522 | 3/2004 |
| JP | 2008-059834 | 3/2008 |
| JP | 2013-120005 | 6/2013 |
| WO | 02/063926 | 8/2002 |

OTHER PUBLICATIONS

Extended European Search Report dated Jan. 29, 2019 in corresponding European Patent Application No. 17753084.7.

International Search Report of PCT application No. PCT/JP2017/004862 dated Apr. 4, 2017.

English Translation of Chinese Search Report dated Jun. 29, 2020 in Chinese Patent Application No. 201780010310.3.

* cited by examiner

137

138

MICROWAVE HEATING DEVICE

This application is a U.S. national stage application of the PCT International Application No. PCT/JP2017/004862 filed on Feb. 10, 2017, which claims the benefit of foreign priority of Japanese patent applications No. 2016-27505 filed on Feb. 17, 2016 and No. 2017-1555 filed on Jan. 10, 2017, the contents all of which are incorporated herein by reference.

TECHNICAL FIELD

The present invention relates to a microwave heating device, such as a microwave oven, configured to radiate microwaves toward a heating target to dielectrically heat the heating target.

BACKGROUND ART

A microwave oven typically exemplifying a microwave heating device is configured to supply microwaves radiated from a magnetron as a typical microwave radiation device into a heating chamber covered with metal, to dielectrically heat food representing a heating target placed in the heating chamber with electric field components in the microwaves.

The heating chamber is covered with metal to safely inhibit microwaves from leaking outward. The microwaves in the heating chamber are thus contained and reflected repeatedly. The heating chamber is much larger than wavelengths (about 120 mm for a microwave oven) of the microwaves, so that there are generated some standing waves in the heating chamber.

The generated standing waves each have constantly strong electric field positions (antinodes of the standing wave) and constantly weak electric field positions (nodes of the standing wave). Positioning of food is thus relevant to a heating degree. Food positioned at the "antinode" with the strong electric field is heated well, whereas food positioned at the "node" with the weak electric field is heated poorly. This is a main factor of uneven heating by a microwave oven, and a particular portion of food can become hot whereas a remaining portion of the food can remain cold.

In order to prevent such uneven heating due to standing waves, there have been developed a configuration to rotate a food placing table provided in a heating chamber to positionally shift the food in the heating chamber (a so-called turntable form), a configuration to rotate an antenna that radiates microwaves without moving food (a rotary antenna form), and the like. These forms have been devised to achieve even heating of food as much as possible while failing to eliminate standing waves.

Meanwhile, there has been effort to achieve local heating of heating only a particular portion of food. For example, an antenna having high microwave radiation directivity is controlled in terms of a direction to irradiate a particular portion of food with direct waves of microwaves as much as possible to achieve local heating of the particular portion of the food. This technique achieves even heating of food including only one article by directing the antenna having high microwave radiation directivity to a low-temperature portion of the food and radiating microwaves while detecting temperature of the food with use of an infrared sensor or the like (see PTL 1 and the like).

When food includes two or more articles, only a particular one of the articles may possibly be heated concentratedly. Specific examples include simultaneously heating two articles of frozen rice and a refrigerated side dish. These articles, which have initial temperature totally different from each other (e.g., −20° C. and 8° C.), are desirably heated to similar temperature (e.g., 70° C.) and are thus different in energy required for heating with a ratio of (70° C.−(−20° C.)):(70° C.−8° C.)≈1.5:1. The antenna having high microwave radiation directivity is thus directed to the frozen rice requiring more energy to radiate direct waves of microwaves for local heating in the heating chamber, to achieve simultaneous finish of heating the food including the two articles (see PTL 2 and the like).

CITATION LIST

Patent Literatures

PTL 1: Unexamined Japanese Patent Publication No. 2008-59834

PTL 2: Unexamined Japanese Patent Publication No. 2013-120005

SUMMARY OF THE INVENTION

Conventional microwave ovens have, however, been limited in local heating performance. Even in a case where one of two articles of food is locally heated with use of an antenna having the highest directivity for a current microwave oven, energy concentrated on the articles has a ratio of at most about 2:1. The two articles of the frozen rice and the refrigerated side dish need to be heated at the energy ratio of 1.5:1. If there is the function of concentrating energy on respective articles at the ratio of about 2:1 larger than 1.5:1, these articles can be heated finely.

Examples of such food to be warmed with use of a microwave oven include hamburg steak and fresh vegetable placed on a single plate. It should be desired "to heat only the hamburg steak and not to absolutely heat the fresh vegetable" in this case. Such precise local heating is impossible and the fresh vegetable is heated to some extent.

Specifically, in a case where the plate having the hamburg steak and the fresh vegetable is placed on a dining table, the hamburg steak and the fresh vegetable each have initial temperature at room temperature (e.g., 20° C.). In order to heat the hamburg steak to appropriate temperature (e.g., 70° C.) while inhibiting temperature of the fresh vegetable from exceeding temperature too high for eating (e.g., body temperature of 37° C.), the energy ratio is required to be about (70° C.−20° C.):(37° C.−20° C.)≈3:1. This indicates necessity for performance of concentrating energy twice of the energy having the ratio of 1.5:1 necessary for heating the frozen rice and the refrigerated side dish. The energy ratio of 2:1 is still inadequate, which is achieved by the current microwave oven antenna having the highest microwave radiation directivity.

Influence by reflected waves and standing waves need to be considered as to why the current microwave oven antenna has local heating performance limited to the ratio of about 2:1 of heating energy concentrated on the two articles of food.

Even when an antenna having high microwave radiation directivity is directed to food and actually irradiates the food with direct waves of microwaves, the food does not absorb all the microwaves. There are also microwaves reflected by a surface of the food and microwaves transmitted through the food. Such microwaves not absorbed upon first collision of direct waves of microwaves are entirely reflected by walls of the heating chamber to become reflected waves, part of which collides with the fresh vegetable. When standing waves are generated through repeated reflection of the reflected waves by the walls, the fresh vegetable positioned at the antinodes of the standing waves is particularly heated to readily be increased in temperature.

Standing waves are investigated and studied in terms of a mechanism.

The heating chamber containing no food and having no load can be regarded as a cavity resonator having a substantially rectangular parallelepiped shape. Such a cavity resonator has a standing wave mode calculated in accordance with (formula 1).

$$\frac{1}{\lambda_0^2} = \left(\frac{m}{2X}\right)^2 + \left(\frac{n}{2y}\right)^2 + \left(\frac{P}{2z}\right)^2 \quad \text{[Formula 1]}$$

Formula 1 includes $\lambda_0$ denoting a free space wavelength of a microwave, X, y, z each denoting a side of the cavity resonator, and m, n, P each denoting a number of antinodes or nodes of a standing wave generated along side X, y, z. This state can be called a "mode mnp". Side X, y, z for a household microwave oven is about 200 mm to 500 mm longer than the free space wavelength (about 120 mm). There are thus a large number of sets of m, n, P satisfying (formula 1).

Exemplary standing wave distribution will be described with reference to electromagnetic field simulation.

FIG. 25 is a perspective view of microwave oven 1 adopted as an electromagnetic field simulation model. FIG. 25 depicts heating chamber 2 having a rectangular parallelepiped shape, and does not depict a magnetron configured to excite microwaves having an electric field of 2.45 GHz at power feeding point 4 of waveguide 3. Waveguide 3 has opening 5 and opening 6 provided at a boundary with heating chamber 2 and configured to be openable individually.

FIG. 26 and FIG. 27 each depict a result of electromagnetic field simulation, including a rear half (a +y portion) of microwave oven 1 depicted in FIG. 25 cut along symmetric axis 15(16)-15(16). FIG. 26 depicts a state where only opening 5 is opened, whereas FIG. 16 depicts a state where only opening 6 is opened. FIG. 26 and FIG. 27 are electric field intensity contour maps depicting electric field distribution obtained by steady state analysis according to a finite element method. An area having narrow patterns like growth rings can be regarded as having a strong electric field (an antinode of a standing wave).

FIG. 26 and FIG. 27 thus indicate difference of standing waves due to positional difference of the opening in the heating chamber having a constant shape. FIG. 26 depicts the state where only opening 5 is opened and the standing waves have four antinodes in an x direction, three antinodes in a y direction, and one antinode in a z direction in heating chamber 2, and this state is called "mode 431". FIG. 27 depicts the state where only opening 6 is opened and the standing waves have five antinodes in the x direction, one antinode in the y direction, and one antinode in the z direction in heating chamber 2, and this state is called "mode 511".

Only difference in position of the opening in the heating chamber having the constant shape thus causes difference of the standing waves, and food has a different portion to be likely to be heated. These standing wave modes each have distribution symmetric about a center of heating chamber 2 in each of the X, y, z directions.

Although the distribution is simple when heating chamber 2 contains no food, distribution is complicated when food (a dielectric substance having permittivity ε) is provided in the same configuration. It has been known that waves propagated in a dielectric substance have a compressed wavelength (effective wavelength $\lambda=\lambda 0/\sqrt{\varepsilon}$). Heating chamber 2 is influenced as if slightly increased in size by food placed in heating chamber 2. There may be generated another standing wave (having a rather high degree) because of the food placed in heating chamber 2. Moreover, food can be of any type and can have any shape. It is thus difficult to estimate conditions of generated standing waves.

Microwave oven 1 has a quite wide available frequency range (2.4 GHz to 2.5 GHz). Particularly when a magnetron is provided as a microwave radiation device, the magnetron has an oscillating frequency uncontrolled and varied individually. In addition, the same magnetron has an oscillating frequency that is highly likely to be varied due to temperature of the magnetron itself, difference in matching state (reflectivity) with a load, and the like. A frequency is in inverse proportion to a wavelength and $\lambda_0=c/f$ (c denoting light speed and being constant) is established. Change in frequency f leads to change in wavelength $\lambda_0$, so that value $\lambda_0$ in (formula 1) changes to cause change of standing waves.

Heating chamber 2 is not strictly formed into a rectangular parallelepiped shape. For example, the wall of heating chamber 2 is provided with a rail allowing a metal oven cocking plate to be mounted and formed by drawing a metal board configuring the wall. The wall can further be processed by multistage pressing for prevention of slight deformation of the wall due to cabinet internal temperature and sound generated by such deformation. There can be a tubular heater or a sheathed heater configured to radiation heat food and exposed into a cabinet. Heating chamber 2 typically has an openable front door. The door and heating chamber 2 have a gap therebetween varied in size depending on a fitting state of the door. These conditions influence values X, y, z in (formula 1) to change standing waves.

Single microwave oven 1 can have estimation to some extent on specification of actually generated standing waves by accurately measuring an oscillating frequency with use of a spectrum analyzer, preliminarily measuring permittivity of food, and modeling in detail an internal structure of heating chamber 2, through analysis with use of recent excellent electromagnetic field simulation software. Specification of standing waves will still be difficult in consideration of the above variation factors. It will also be impossible to control to obtain appropriate standing waves.

Assuming that appropriate standing waves can be obtained through control and the hamburg steak and the fresh vegetable are placed on the single plate, the required energy ratio of 3:1 may be achieved when the hamburg steak is placed at an antinode of a standing wave and the fresh vegetable is placed at a node of a standing wave. This energy ratio corresponds to a ratio between energy injected to the entire hamburg steak and energy injected to the entire fresh vegetable. If the energy injected to the fresh vegetable is not even but has uneven distribution to be concentrated on part of the fresh vegetable, the part will be increased in temperature.

A standing wave has antinodes and nodes having a pitch determined by length and a direction of a side of heating chamber 2 (FIG. 26 seems to have similar pitches in the x direction and the y direction, whereas FIG. 27 has a small pitch in the x direction and a large pitch in the y direction). The pitch is averaged to about a half-wavelength (about 60 mm). The standing wave changes between the antinode and the node not digitally like a waveform of a square wave but gradually increases or decreases like a waveform of a sine wave. The standing wave will thus have a really weak electric field only in a range from one-fourth of the wavelength to one-eighth of the wavelength (15 mm to 30 mm) around the node.

The fresh vegetable placed at the node needs to have certain size in this case. However, limiting the fresh vegetable to have a side not exceeding 15 mm or 30 mm for placing at a position of a weak electric field is not practical for a consumer cooker. Typical fresh vegetable will have length of a single wavelength (120 mm) or at least a half-wavelength (60 mm).

There is an approach to standing wave control other than selecting desired standing waves. Specifically, local heating performance may be improved if standing waves can be polarized by collecting antinodes of the standing waves within a half region in heating chamber 2, for example. Various standing waves are analyzed through electromagnetic field simulation and it is found that every standing wave is substantially symmetric in an inner region except a region close to each wall, even when having an asymmetric outer shape due to unevenness of the wall, has evenly alternated antinodes and nodes, and cannot be polarized asymmetrically.

The present invention provides a microwave heating device configured to control standing wave distribution in a heating chamber.

The microwave heating device according to the present invention includes a heating chamber, a microwave radiation device configured to radiate a microwave into the heating chamber to heat a heating target, and a reflection angle control device provided at least part of a wall of the heating chamber and configured to control a reflection angle of the microwave to control standing wave distribution in the heating chamber.

This configuration causes the reflection angle control device to control the reflection angle of the microwave when the microwave radiated from the microwave radiation device is not directly absorbed into the heating target but is reflected by the wall. The standing wave distribution in the heating chamber can thus be controlled to be different from ordinary distribution for improvement in local heating performance.

DESCRIPTION OF EMBODIMENTS

A microwave heating device according to preferred exemplary embodiments of the present invention will now be described below with reference to the accompanying drawings. The microwave heating device according to the following exemplary embodiments will be described by exemplifying a microwave oven but is not limited to the microwave oven. Examples of the microwave heating device include a heating device utilizing dielectric heating, a garbage disposal unit, and a semiconductor manufacturing device. The present invention is not limited to the specific configurations according to the following exemplary embodiments, but includes configurations according to similar technical ideas.

First Exemplary Embodiment

Figure 1:
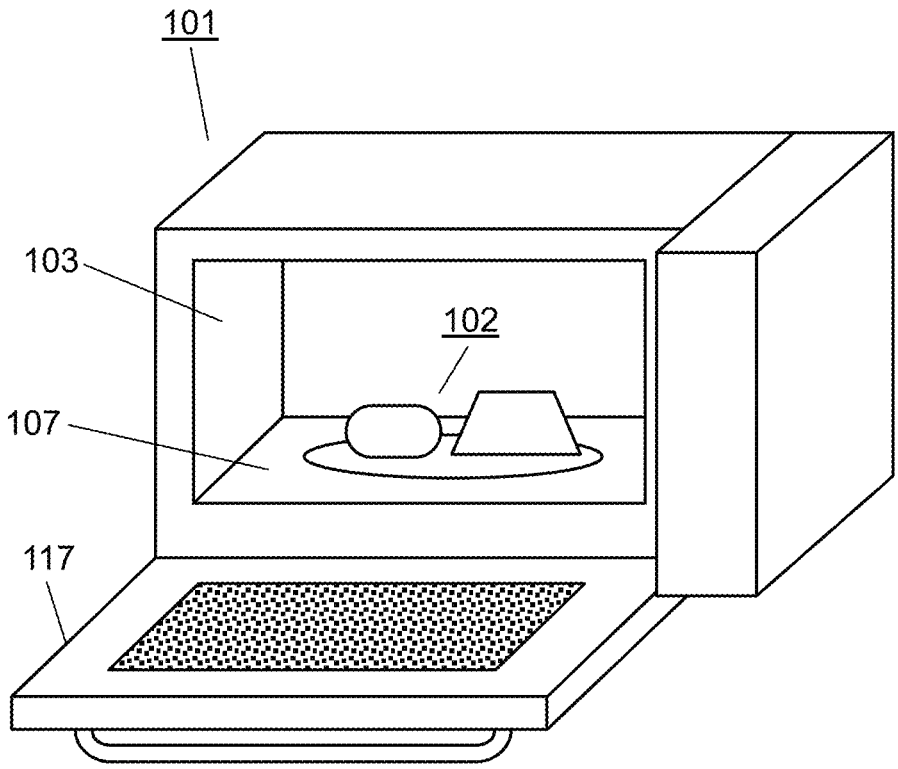
FIG. 1 is a perspective view of a microwave heating device according to a first exemplary embodiment of the present invention, including a door in an opened state.
Figure 2:
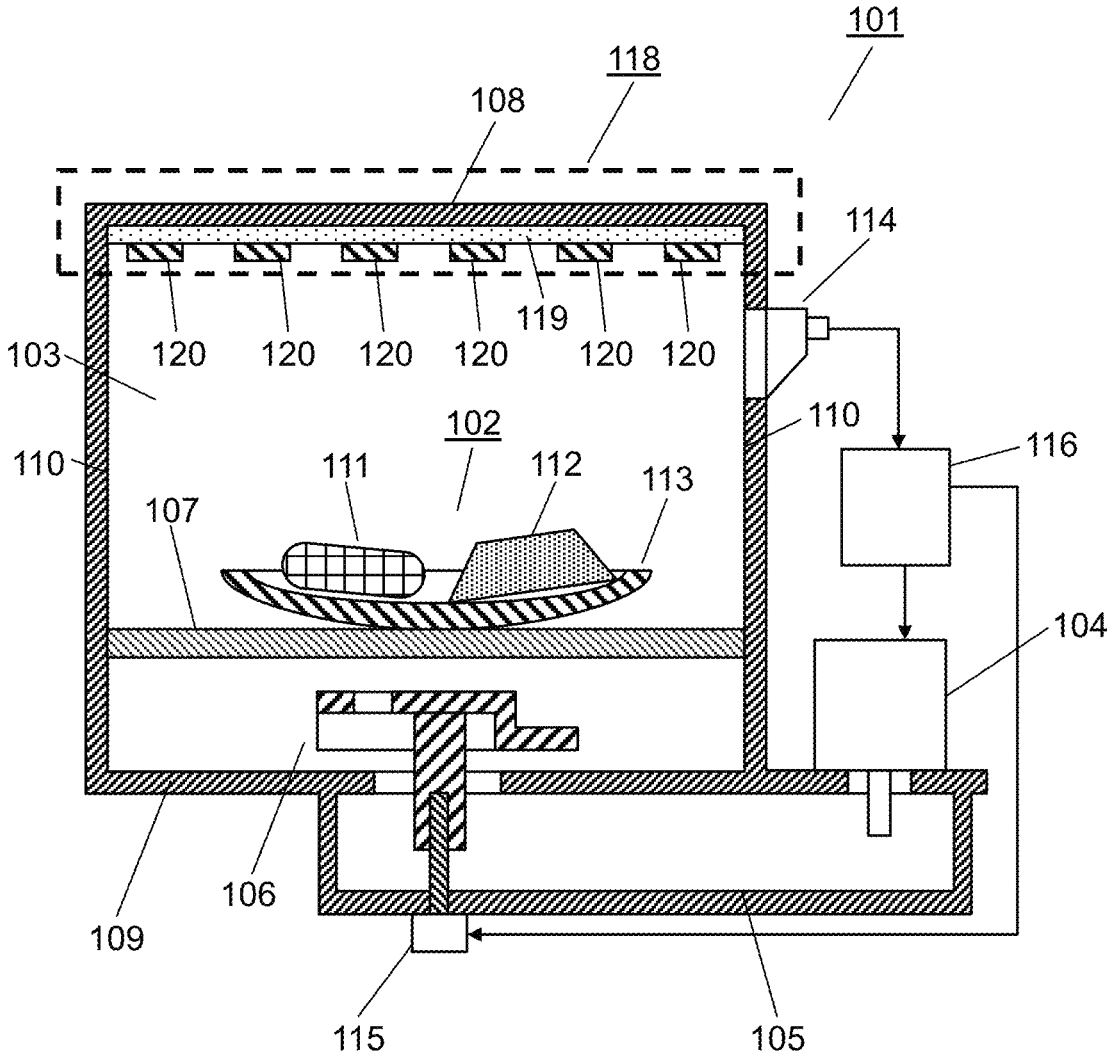
FIG. 2 is a schematic configuration diagram of the microwave heating device according to the first exemplary embodiment of the present invention.

FIG. 1 and FIG. 2 depict a microwave heating device according to a first exemplary embodiment of the present invention. FIG. 1 is a perspective view of an entire configuration, and FIG. 2 is a sectional view from a front.

Microwave oven 101 typically exemplifying the microwave heating device includes heating chamber 103 configured to accommodate food 102 as a typical heating target, and magnetron 104 functioning as a typical microwave radiation device. Microwave oven 101 further includes waveguide 105 configured to guide microwaves radiated from magnetron 104 into heating chamber 103, and antenna 106 having high microwave radiation directivity, disposed above waveguide 105, and functioning as a microwave radiation unit configured to radiate microwaves in waveguide 105 into heating chamber 103. There is also provided, above antenna 106, placing table 107 for food 102.

Placing table 107 closes a lower end of heating chamber 103 so as not to cause antenna 106 to be exposed into a cabinet. Placing table 107 flattens a placement surface for food 102 to allow a user to easily insert and remove food 102 and easily wipe the placement surface when food is spilt on or adheres to the placement surface. Placing table 107 is made of a material like glass or ceramics, which is likely to transmit microwaves, so as to radiate microwaves from antenna 106 into heating chamber 103.

Heating chamber 103 has walls (upper wall 108, bottom wall 109, and side wall 110) forming a substantially rectangular parallelepiped shape and configured by conductive boards. Food 102 includes hamburg steak 111 and fresh vegetable 112 placed on plate 113. Side wall 110 has an upper right portion provided with infrared sensor 114 configured to detect temperature of food 102, and there is provided, under waveguide 105, motor 115 configured to rotate antenna 106. Microwave oven 101 further includes controller 116 configured to receive a signal from infrared sensor 114 and control operation of magnetron 104 and motor 115, and door 117 openable forward as depicted in FIG. 1.

Waveguide 105, heating chamber 103, and closed door 117 form a closed space containing microwaves that typically generate some standing waves. Heating chamber 103 has an upper region including upper wall 108 configuring part of the walls of heating chamber 103 and provided with reflection angle control device 118. Reflection angle control device 118 includes upper wall 108, dielectric layer 119 connected to upper wall 108, and a large number of conductive patches 120 connected to dielectric layer 119, and is configured to reflect upward microwaves to control a reflection angle of the microwaves.

Microwave oven 101 thus configured will be described in terms of operation.

Microwaves radiated from magnetron 104 are transmitted through waveguide 105 and are radiated from antenna 106 into heating chamber 103. In a typical case where food including single article is warmed, the food is desired to be heated evenly. Antenna 106 having high microwave radiation directivity thus radiates microwaves into heating chamber 103 while being rotated by motor 115.

In another case where local heating is required at a ratio of energy necessary for heating of about 1.5:1, for example, food including two articles different in initial temperature, such as frozen rice and a refrigerated side dish, is warmed, antenna 106 stopped and directed toward the frozen rice radiates microwaves for certain time. If antenna 106 has performance achieving at least 1.5:1 (e.g., 2:1 as the highest performance of currently available products) as a ratio of concentrated energy while antenna 106 is directed toward the frozen rice, heating at the most appropriate energy ratio of 1.5:1 is enabled by appropriately providing the time for stopping antenna 106 directed toward the frozen rice and time for directing antenna 106 in different directions.

More specifically, assume that a user places the frozen rice and the refrigerated side dish in heating chamber 103, presses a warming key in an operation unit (not depicted) or the like to set automatic heating to 70° C., and starts heating.

Infrared sensor 114 initially measures temperature of food 102. Controller 116 then determines temperature distribution of food 102 (the frozen rice has low temperature and the refrigerated side dish has high temperature) in accordance with a signal from infrared sensor 114. Controller 116 drives motor 115, controls antenna 106 to have a direction of high microwave radiation directivity aligned with a direction toward the frozen rice, and starts magnetron oscillation, to target the frozen rice determined as having low temperature in the two articles of food.

Both the frozen rice and the refrigerated side dish will be increased in temperature when heated simply. The frozen rice is, however, increased in temperature quicker than the refrigerated side dish because energy absorbed into the frozen rice is twice in amount of energy absorbed into the refrigerated side dish. These articles have temperature difference gradually decreasing as heating time elapses and reach temperature similar to each other. These articles will have temperature inverted if heated continuously. Infrared sensor 114 is configured to monitor the temperature difference between the articles. When controller 116 determines that the temperature difference between the articles is equal to or less than a certain threshold, controller 116 drives motor 115 to rotate antenna 106 having been kept directed toward the frozen rice.

This changes the radiation energy ratio for the articles from 2:1 to 1:1, and the articles will thereafter be kept increased in temperature substantially equally. When infrared sensor 114 detects temperature reaching a target temperature of 70° C., magnetron oscillation is stopped to end the heating. The both two articles of food different in initial temperature reach 70° C. at the end of the heating as set by the user, achieving simultaneous warming of the two articles of food.

An exemplary case where higher local heating performance is required will be described next. In a case where hamburg steak 111 and fresh vegetable 112 are combined and placed on single plate 113 as depicted in FIG. 2, it is desired to heat only hamburg steak 111 and not to heat fresh vegetable 112 as much as possible. It is, however, insufficient to stop antenna 106 such that the direction of high microwave radiation directivity is aligned with the direction toward hamburg steak 111. Reflection angle control device 118 thus controls to cause upward microwaves to be reflected at a reflection angle toward hamburg steak 111.

In an exemplary case where microwaves proceed vertically upward in FIG. 2, reflection angle control device 118 causes the microwaves to be reflected slightly leftward and downward and causes reflected waves to be directed toward the hamburg steak. Antenna 106 radiates direct waves directed toward hamburg steak 111, and the direct waves include microwaves that are not absorbed into hamburg steak 111 and are reflected by reflection angle control device 118 to become reflected waves to be directed toward hamburg steak 111. Both the direct waves and the reflected waves are applied for local heating in this manner for significant improvement in local heating performance. Only hamburg steak 111 can thus be warmed with slight increase in temperature of fresh vegetable 112. As to be described later, reflection angle control device 118 also polarizes standing wave distribution in heating chamber 103 in this case. Reflection angle control device 118 is thus configured to control standing wave distribution that has been regarded as being impossible.

Control of standing wave distribution in heating chamber 103 by reflection angle control device 118 will be described below with reference to FIG. 3 to FIG. 13.

Figure 3:
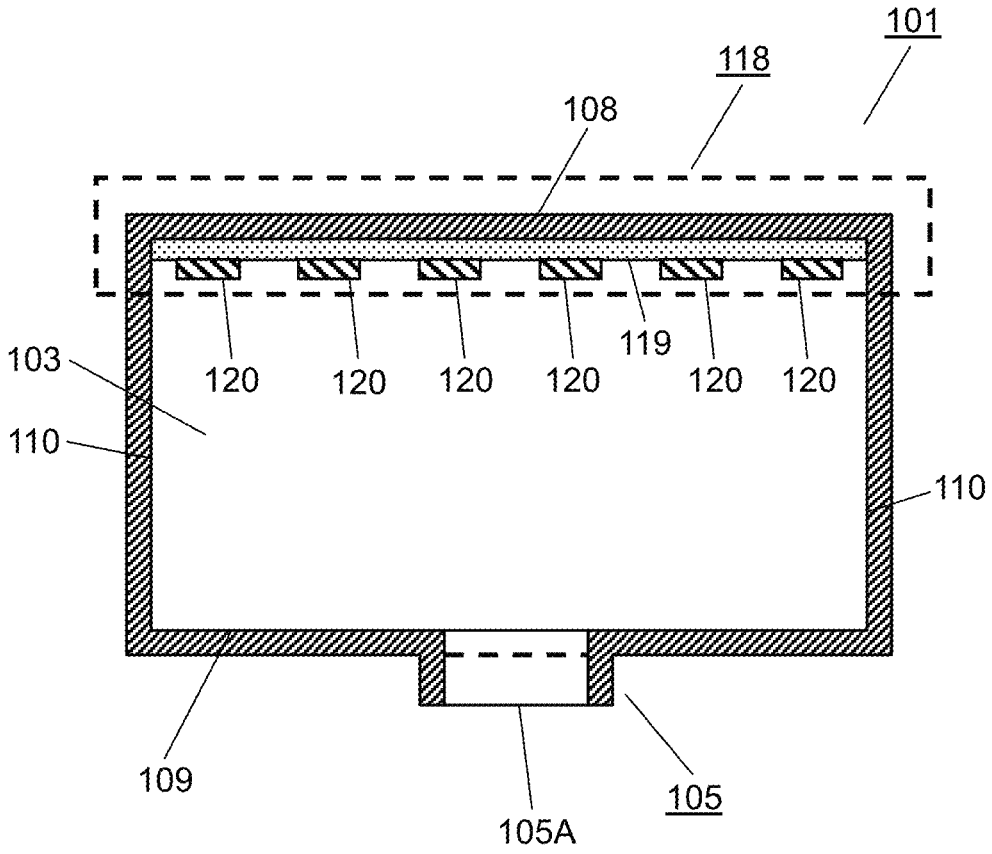
FIG. 3 is a sectional view of an electromagnetic field simulation model of the microwave heating device according to the first exemplary embodiment of the present invention.
Figure 4:
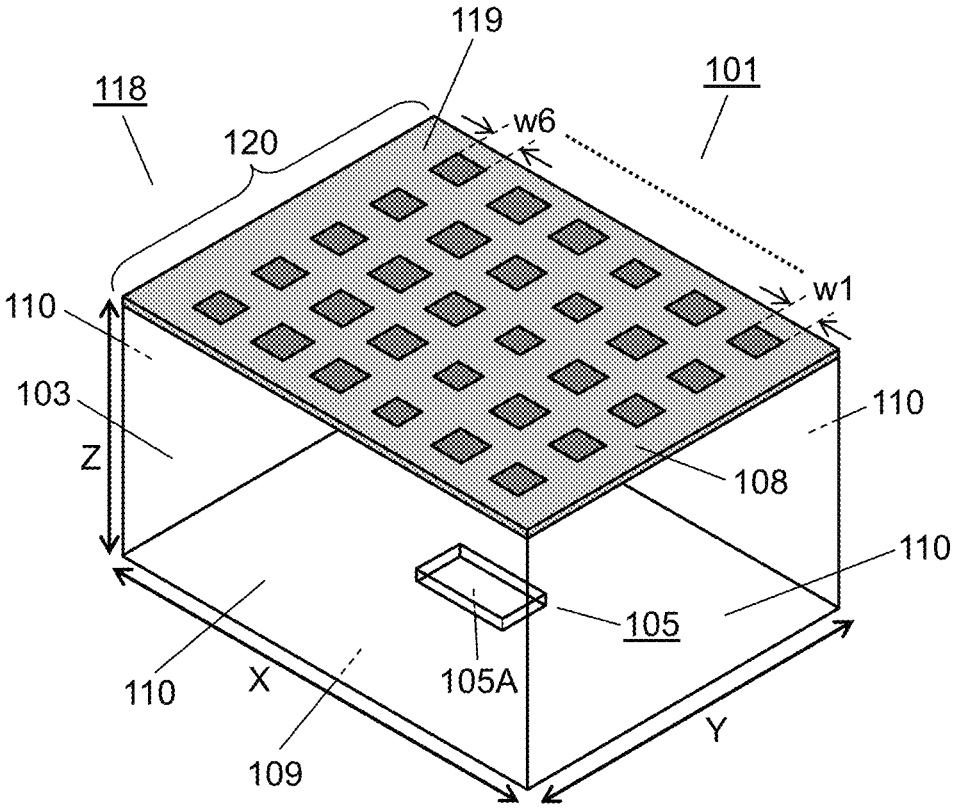
FIG. 4 is a perspective view of the electromagnetic field simulation model of the microwave heating device according to the first exemplary embodiment of the present invention.

FIG. 3 and FIG. 4 each depict a simplified model for electromagnetic field simulation, according to the microwave heating device depicted in FIG. 2.

Similarly to FIG. 2, FIG. 3 is a sectional view from a front of the microwave heating device.

Unlike FIG. 2, microwave oven 101 depicted in FIG. 3 includes no antenna below heating chamber 103, but has a microwave input port in a TE10 mode, provided at open face 105A of waveguide 105 having a simple structure. Microwaves are accordingly supplied into heating chamber 103 via waveguide 105. This model is simplified by providing no door and providing four side walls 110.

FIG. 4 is a perspective view from obliquely upward, of microwave oven 101 depicted in FIG. 3.

FIG. 4 depicts, with solid lines, dielectric layer 119 below upper wall 108, and conductive patches 120 arrayed below dielectric layer 119 to have five lines and six rows, for easier comprehension of the structure of microwave oven 101. Heating chamber 103 is sized similarly to a typical microwave oven, to have width X=410 mm, depth Y=315 mm, and height Z=225 mm. There are 30 conductive patches 120 arrayed to have six rows along width X of heating chamber 103 and five lines along depth Y. Conductive patches 120 each have a square shape and are arrayed such that six conductive patches are aligned along width X to have sides w1 to w6 changed sequentially from a right end and conductive patches equal in shape are aligned to form the five lines along depth Y. Dielectric layer 119 is 5 mm in thickness, and has permittivity of 3.5 and a dielectric loss tangent of 0.004, whereas conductive patches 120 are 35 μm in thickness.

Figure 5:
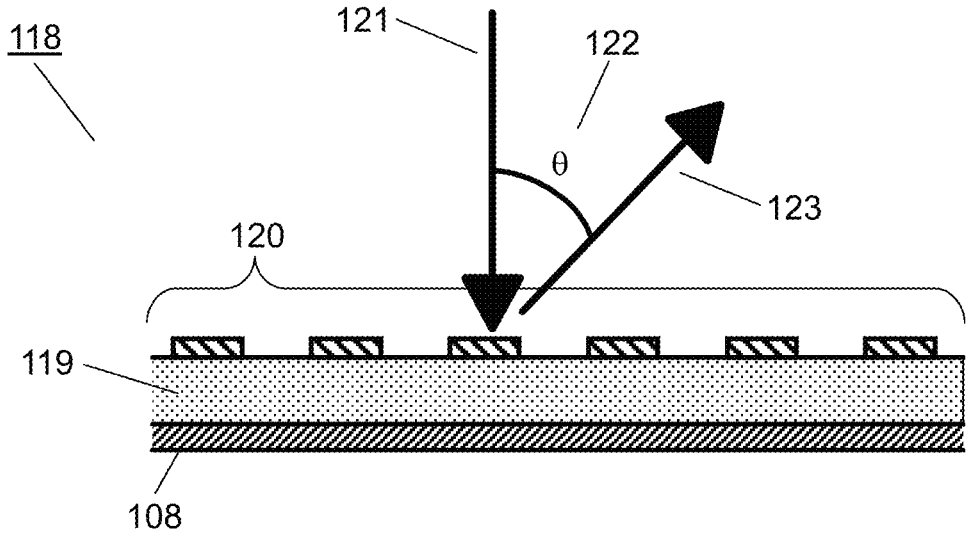
FIG. 5 is an explanatory view of an effect of a reflection angle control device included in the microwave heating device according to the first exemplary embodiment of the present invention.

FIG. 5 is a conceptual explanatory view of an effect of reflection angle control device 118.

A heating chamber has walls typically configured by conductive metal boards. A microwave incident on a metal board has an incident angle and a reflection angle equal to each other in accordance with the Snell's law. As depicted in FIG. 5, vertically downward incident wave 121 is reflected vertically upward at reflection angle θ122 of 0°. Although not depicted, incident wave 121 entering from the left with inclination of 45° is reflected to the right with inclination of 45°.

The present exemplary embodiment provides reflection angle control device 118 configured to change reflection angle θ122 to a specific value. For example, vertically downward incident wave 121 can be reflected rightward and upward like reflected wave 123 as depicted in FIG. 5.

Figure 6:
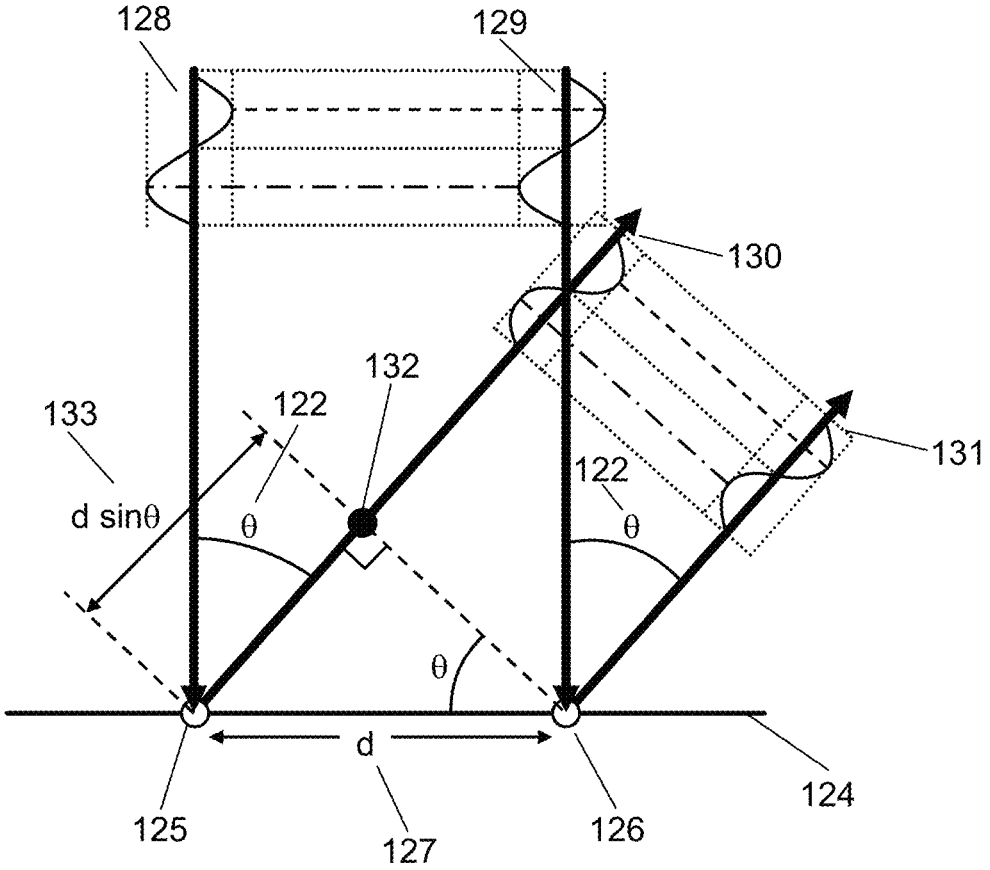
FIG. 6 is an explanatory view of a principle of the reflection angle control device.

FIG. 6 is a conceptual explanatory view of a principle of reflection angle control device 118.

There is provided microwave reflection surface 124 having two reflection points 125, 126 apart from each other by distance d127. Assuming a case where incident waves 128, 129 respectively incident at reflection points 125, 126 are sine waves and are incident vertically downward from the top in FIG. 6, incident waves 128, 129 have equal phases in a horizontal direction (in a left-right direction of FIG. 6) and have aligned wave surfaces.

Assume another case where incident waves 128, 129 are reflected by reflection points 125, 126 at reflection angle θ122 to become reflected waves 130, 131, respectively. Reflected waves 130, 131 need to have wave surfaces aligned at reflection angle θ122 so as to be transmitted at reflection angle θ122 as totally associated waves without cancelling with each other. Reflection point 126 and point 132 need to have phases matching each other. Point 132 is positioned where a line including reflection point 126 and being perpendicular to reflected wave 130 crosses reflected wave 130.

Incident wave 128 is still positioned at reflection point 125 when incident wave 129 reaches reflection point 126, and needs more time to reach point 132. Reflection point 125 and point 132 have distance (route difference) of d·sin θ133. In order to match the phases at reflection point 126 and point 132 for wave surface alignment, reflection point 125 can have a reflection phase leading a reflection phase at reflection point 126 by the route difference of d·sin θ133.

The reflection phase to be led is expressed by a radian, as $k \cdot d \cdot \sin\theta$ with use of wavenumber $k=2\pi/\lambda_0$. In an exemplary case where distance d127 is 30 mm, reflection angle θ122 is 20°, wavelength $\lambda_0$ of a microwave is accurately obtained as $\lambda_0=c/f=300/2.45\approx122.45$ mm, the reflection phase to be led is $k \cdot d \cdot \sin\theta=2\pi/\lambda_0 \cdot d \cdot \sin\theta=2\pi/122.45\times30\times\sin 20°\approx0.526$ radians, i.e. $0.526/(2\pi)\times360\approx30°$.

When the reflection phase at reflection point 125 is made larger by 30° than the reflection phase at reflection point 126, rightward reflection can be achieved at reflection angle θ122 of 20° as intended.

As described above, if there is a method of appropriately determining the reflection phases at reflection points 125, 126, microwaves can be reflected at appropriate reflection angle θ122 by appropriate selection of a difference between these reflection phases.

A method of appropriately determining a reflection phase will be described next with reference to FIG. 7 and FIG. 8.

Figure 7:
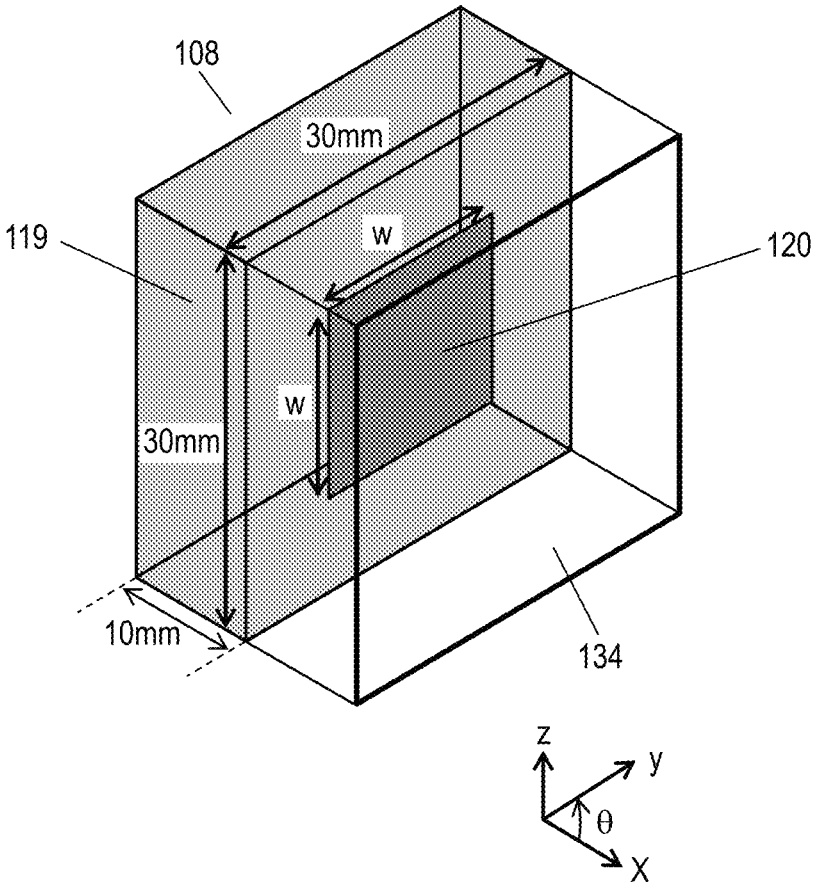
FIG. 7 is an explanatory perspective view of a method of appropriately determining a reflection phase.

FIG. 7 depicts a configuration including only one conductive patch 120 cut out of reflection angle control device 118

Incident surface 134 for microwaves is set as an input port, and a reflection phase of a microwave inputted from incident surface 134 and observed as reflected wave returning to incident surface 134 is obtained through analysis. FIG. 7 depicts the cut out portion in a square shape having each side of 30 mm, and dielectric layer 119 having thickness of 10 mm. The reflection phase is changed by changing only the shape of conductive patch 120 with the outer shape having each side of 30 mm being unchanged. The configuration depicted in FIG. 7 is called a unit cell. A plurality of the unit cells is eventually arrayed on the wall of the microwave oven. The simulation includes representation of an infinite period structure including the unit cells having outer peripheral boundary conditions of an xy plane and a zx plane as periodic boundaries and being arrayed infinitely in the y direction and the z direction.

Figure 8:
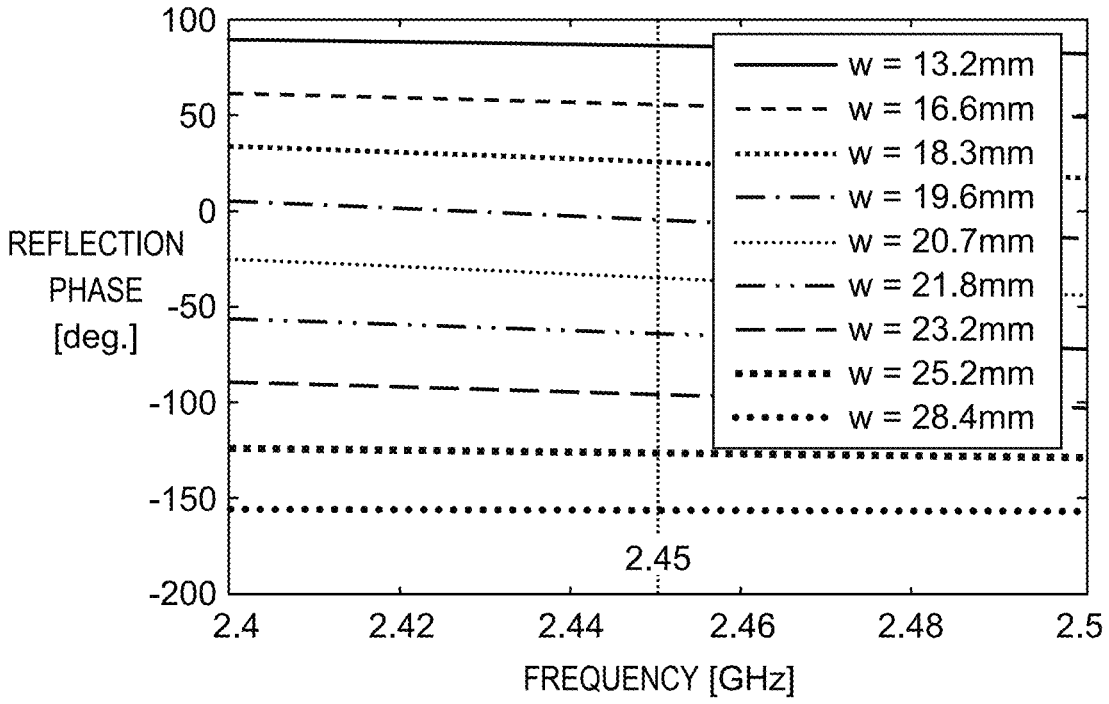
FIG. 8 is a characteristic graph of the reflection phase with respect to a size of a conductive patch.

FIG. 8 is a characteristic graph of plotted reflection phases obtained through the analysis with each side w of conductive patch 120 depicted in FIG. 7 as a parameter. The graph has a transverse axis indicating a frequency and an ordinate axis indicating a reflection phase. When the frequency is 2.45 GHz, the reflection phase is about 90° when w=13.2 mm, about 60° when w=16.6 mm, and about 30° when w=18.3 mm. According to the graph, the reflection phase can be determined freely in accordance with each side w of conductive patch 120.

Figure 9:
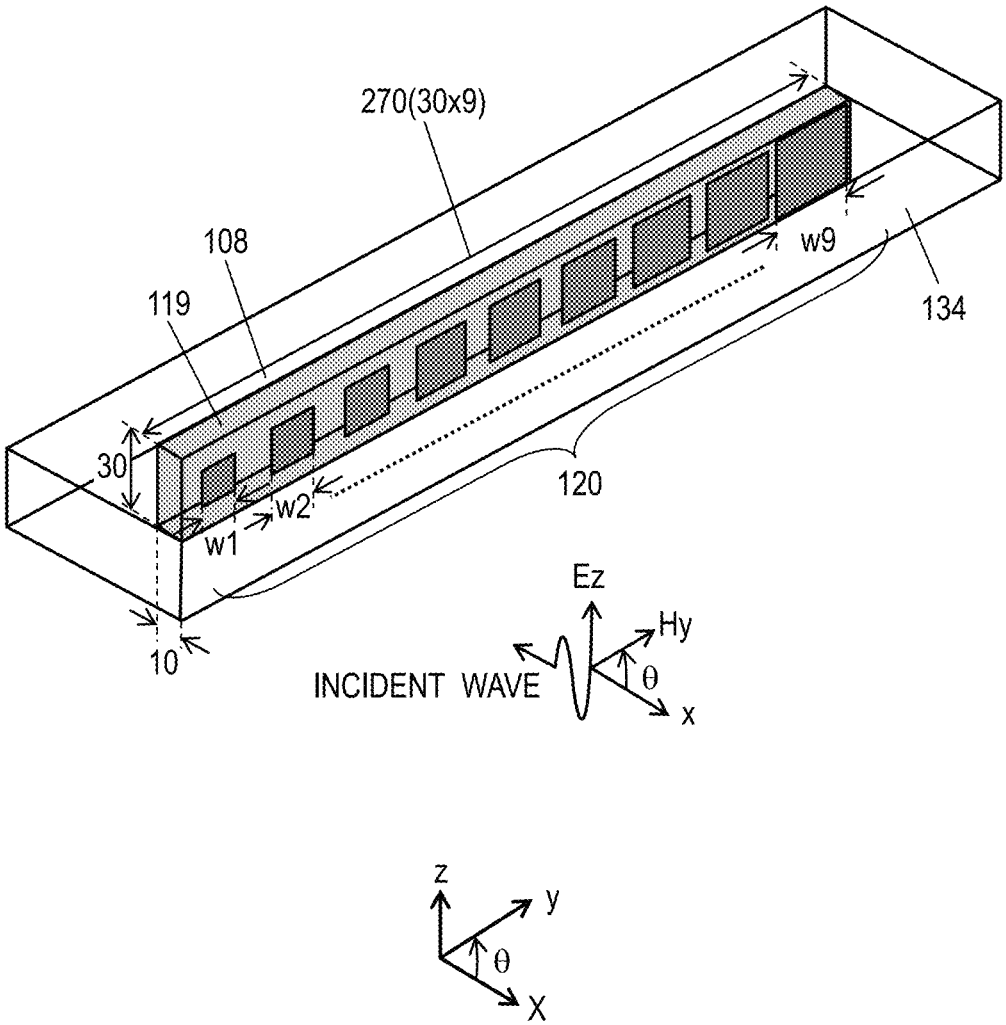
FIG. 9 is a perspective view of conductive patches gradually increased in size and aligned linearly.

FIG. 9 depicts a structure including nine aligned unit cells that have each side of 30 mm and are relevant to FIG. 8. The structure has boundary conditions of the xy plane as a periodic boundary, and a yz plane and the zx plane as absorbing boundaries. A plane wave having an electric field direction along a z axis is inputted to be incident vertically. FIG. 9 depicts a model including conductive patches 120 that are aligned linearly and have sides w of gradually increased w1, w2, . . . w9. Accordingly, the reflection phases of conductive patches 120 decrease gradually. In an exemplary case where w1=13.2 mm and w2=16.6 mm, the adjacent reflection phases has difference obtained by 90°−60°=30°. In another exemplary case where w2=16.6 mm and w3=18.3 mm, the adjacent reflection phases has difference obtained by 60°−30°=30°. Any adjacent reflection phases can thus have difference of 30°. Described with reference to FIG. 6 is the method of setting reflection angle θ122 to 20° by providing the two reflection points. The model depicted in FIG. 9 is expected to set reflection angle θ122 to 20° at any point on the entire plane.

This is an end of description of the principle. When unit cells are arrayed on a wall of an actual microwave oven, the unit cells having each side of 30 mm as described with reference to FIG. 7 to FIG. 9 need to have a large number and are thus changed in shape. Specifically, the unit cells have each side of 60 mm, dielectric layer 119 is 5 mm in thickness, and the unit cells are aligned to form six rows. These six unit cells are aligned to have five lines so as to be arrayed to substantially cover upper wall 108 as depicted in FIG. 4.

According to the change in shape of the unit cells, the adjacent conductive patches require a phase difference of 60.4° even though target reflection angle θ122 is kept 20°. The change also causes change in size of w1 to w6. Specifically, w1 to w6 are set such that w1=15.0 mm, w2=27.6 mm, w3=28.8 mm, w4=29.5 mm, w5=30.4 mm, and w6=32.7 mm. Gradual increase in size of the conductive patches achieves gradual decrease in reflection phase.

In order to further increase target reflection angle θ122 (e.g., 50°), w1 to w6 can be set such that w1=28.6 mm, w2=30.4 mm, w3=24.4 mm, w4=29.2 mm, w5=31.9 mm, and w6=27.7 mm.

Figure 10:
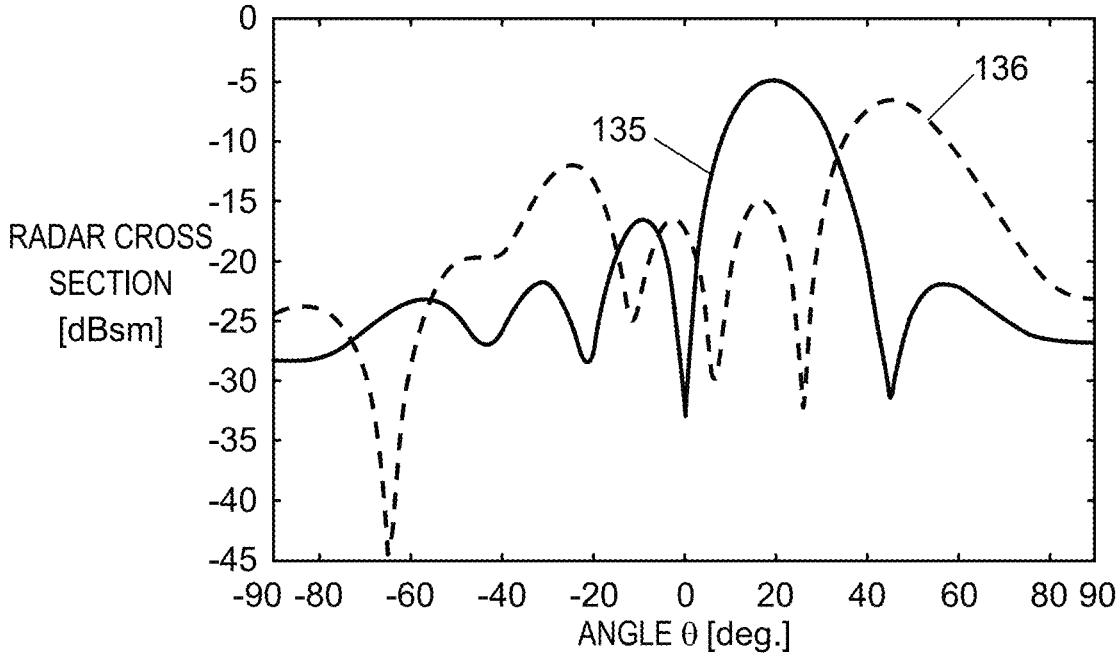
FIG. 10 is a characteristic graph of a reflected wave angle.

FIG. 10 is a characteristic graph of reflection angle θ122 according to a method of evaluating a far field called a radar cross section (RCS). FIG. 10 includes a transverse axis indicating an angle to be observed and an ordinate axis indicating reflection intensity at the angle. Plotted are data 135 with target reflection angle θ122 set to 20° and data 136 with target reflection angle θ122 set to 50° with two parameters, in a case where the unit cells having each side of 60 mm are adopted.

As apparent from FIG. 10, data 135 with target reflection angle θ122 set to 20° has a peak at 20°, whereas data 136 with target reflection angle θ122 set to 50° has a peak at 50°. It is thus quantitatively confirmed that reflection angle θ122 can be controlled in the far field by appropriate determination of sizes w of the conductive patches. Data 136 with target reflection angle θ122 set to 50° larger than 20° is more likely to have increase in unnecessary side lobe (having high peaks at untargeted angles −25° and the like).

Figure 11A:
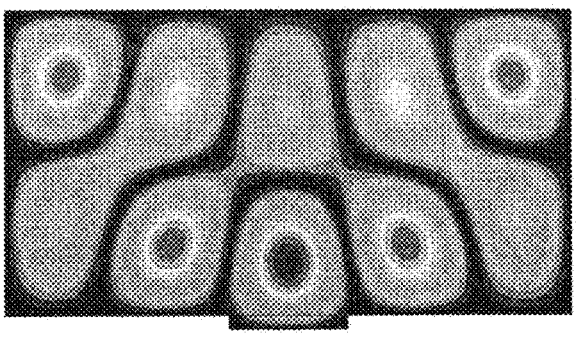
FIG. 11A is a contour diagram of electric field intensity distribution in a case where the reflection angle control device is not provided, by magnetic field simulation of the microwave heating device according to the first exemplary embodiment of the present invention.
Figure 11B:
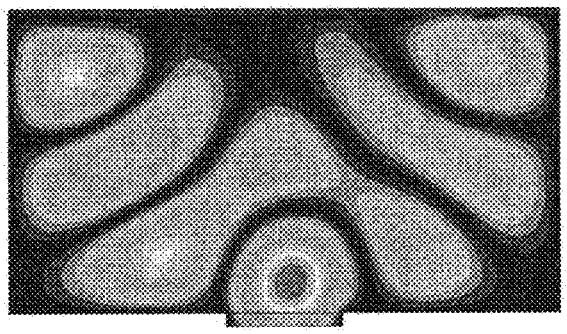
FIG. 11B is a contour diagram of electric field intensity distribution in a case where the reflection angle control device has a reflection angle of 20 degrees, by magnetic field simulation of the microwave heating device according to the first exemplary embodiment of the present invention.
Figure 11C:
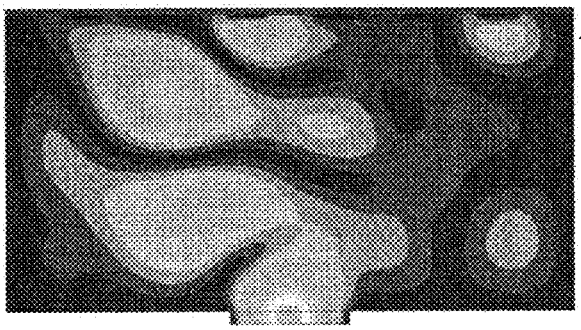
FIG. 11C is a contour diagram of electric field intensity distribution in a case where the reflection angle control device has a reflection angle of 50 degrees, by magnetic field simulation of the microwave heating device according to the first exemplary embodiment of the present invention.

FIG. 11A to FIG. 11C are contour diagrams of electric field intensity distribution in a steady state as results of electromagnetic field simulation through analysis of the entire microwave oven when the ideas described above are applied to the configuration depicted in FIG. 3 and FIG. 4. FIG. 11A to FIG. 11C depict a center cross section of heating chamber 103, viewed as in FIG. 3. FIG. 11A relates to a case where there is provided no reflection angle control device. FIG. 11B relates to a case where reflection angle control device 137 is provided on the upper wall and is designed to have a leftward reflection angle of 20°. FIG. 11C relates to a case where reflection angle control device 138 is provided and is designed to have a leftward reflection angle of 50°. FIG. 11A has standing wave distribution completely bilaterally symmetric. FIG. 11B is slightly less symmetric with stronger standing waves on the left and weaker standing waves on the right. FIG. 11C has no symmetry. FIG. 11C has almost no antinode of a standing wave in the right region particularly in comparison to FIG. 11A.

As described above, provision of reflection angle control device 137, 138 achieves change in position of a strong electric field in a desired direction. Reflection angle control device 138 having larger reflection angle θ122 particularly causes larger change in distribution. The standing wave distribution in heating chamber 103 can thus be controlled to be different from ordinary distribution, although such control has been considered as being impossible.

FIG. 12A to FIG. 12C and FIG. 13A to FIG. 13C relate to results of electromagnetic field simulation under the condition expected to achieve the highest effect out of the cases of FIG. 11A to FIG. 11C, specifically, in the case where reflection angle control device 138 is provided and designed to have leftward reflection angle θ122 of 50°, and two items of food are placed on the left and right in heating chamber 103.

Figure 12A:
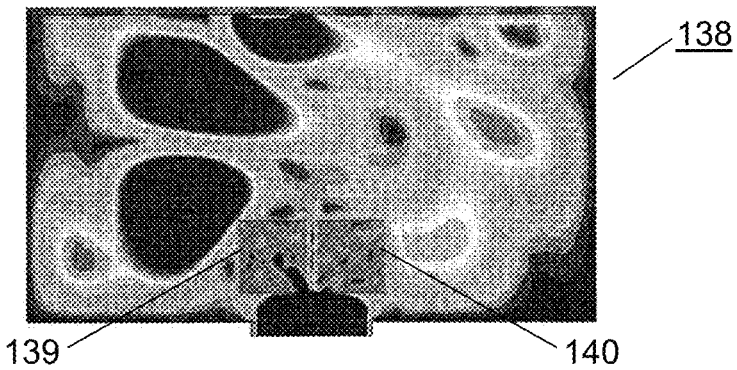
FIG. 12A is a contour diagram of electric field intensity distribution by magnetic field simulation, in a case where beef is placed in a lower region of the microwave heating device according to the first exemplary embodiment of the present invention.
Figure 12B:
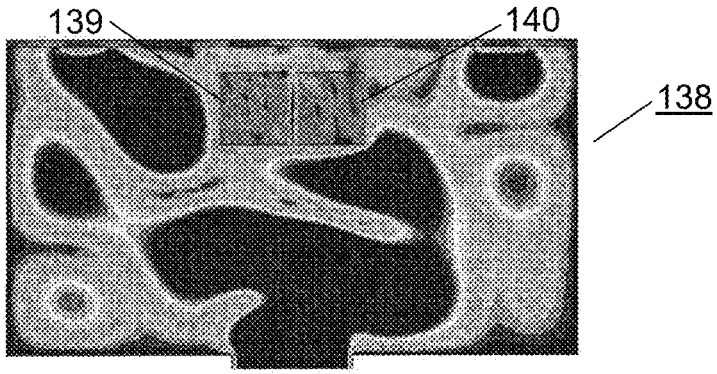
FIG. 12B is a contour diagram of electric field intensity distribution by magnetic field simulation, in a case where beef is placed in an upper region of the microwave heating device according to the first exemplary embodiment of the present invention.
Figure 12C:
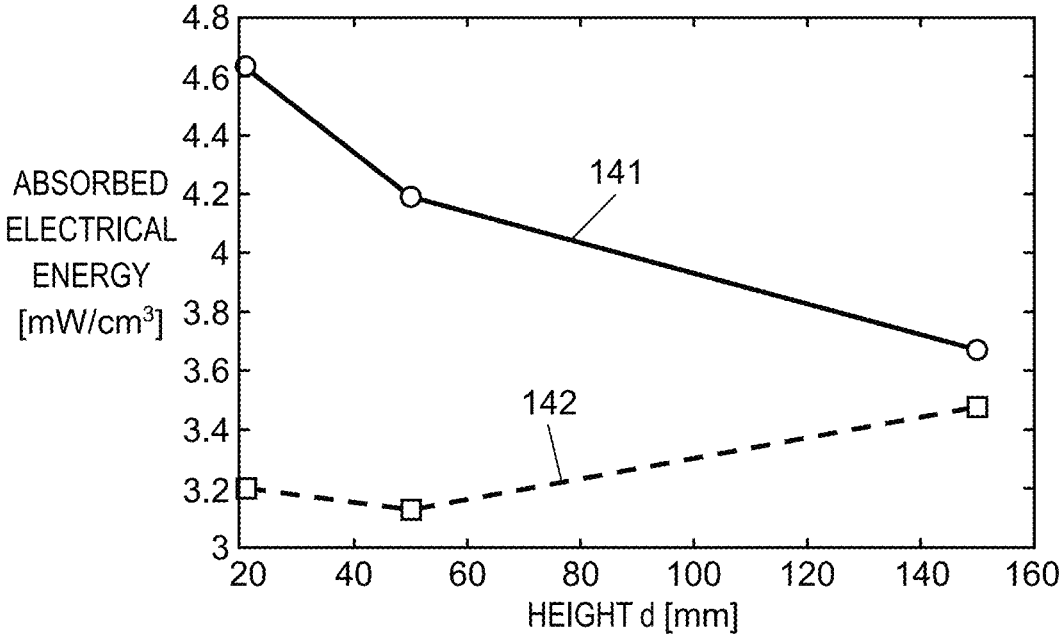
FIG. 12C is a characteristic graph of absorbed electrical energy with respect to height of beef in the microwave heating device according to the first exemplary embodiment of the present invention.

FIG. 12A to FIG. 12C relate to results of calculation with reference to permittivity of beef as the food. Beef 139 as a heating target placed on the left and beef 140 as a heating target placed on the right each have permittivity of 30.5, a dielectric loss tangent of 0.311, and a columnar shape with 100 mL in volume, 25 mm in radius, and 51.3 mm in height. FIG. 12A depicts electric field intensity distribution in a case where the food is placed in the lower region, and has standing wave distribution polarized to the left. FIG. 12B depicts electric field intensity distribution in a case where the food is placed in the upper region, and has irregular standing wave distribution having antinodes of standing waves also on the right. FIG. 12C is a characteristic graph inclusive of the cases of FIG. 12A and FIG. 12B, with height d of the food plotted on a transverse axis and absorbed electrical energy of the food plotted on an ordinate axis. Left beef 139 has characteristic 141, and right beef 140 has characteristic 142. Regardless of height d of the placed food, characteristic 141 has constantly larger absorbed electrical energy. Characteristic 141 and characteristic 142 have larger difference particularly when height d is smaller, and microwaves are concentrated on left beef 139 as intended.

Figure 13A:
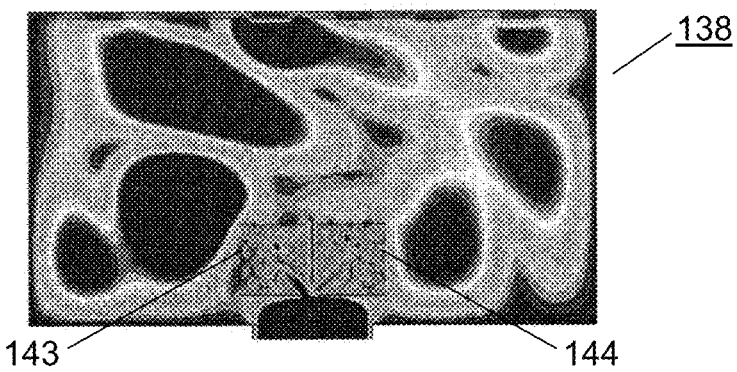
FIG. 13A is a contour diagram of electric field intensity distribution by magnetic field simulation, in a case where water is placed in a lower region of the microwave heating device according to the first exemplary embodiment of the present invention.
Figure 13B:
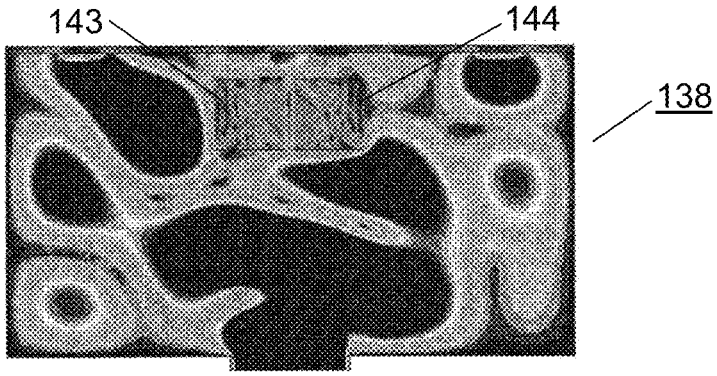
FIG. 13B is a contour diagram of electric field intensity distribution, in a case where water is placed in an upper region of the microwave heating device according to the first exemplary embodiment of the present invention.
Figure 13C:
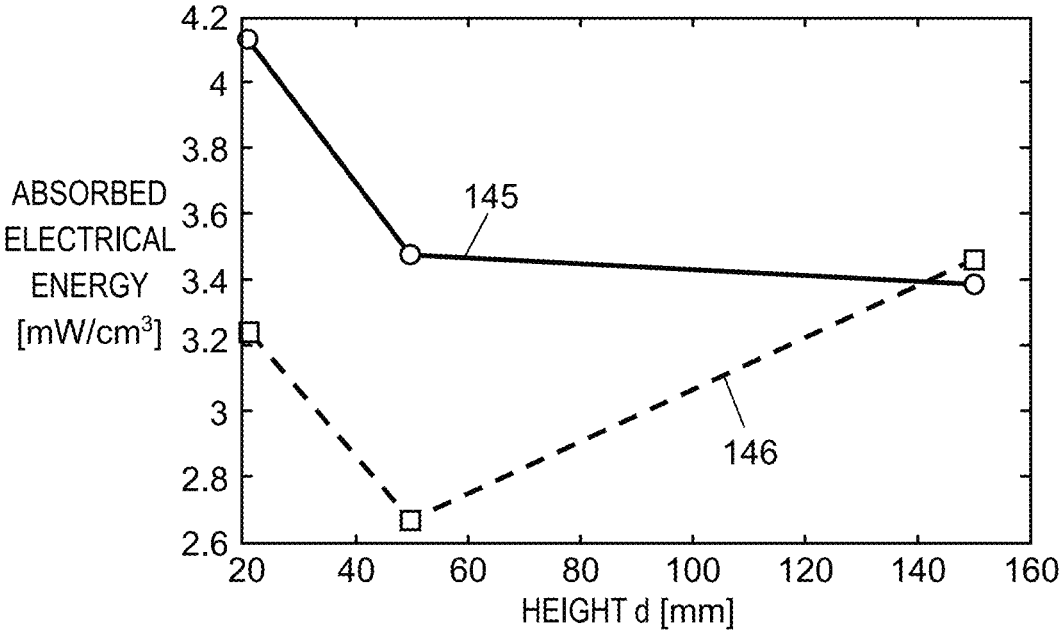
FIG. 13C is a characteristic graph of absorbed electrical energy with respect to height of water in the microwave heating device according to the first exemplary embodiment of the present invention.

FIG. 13A to FIG. 13C relate to results of calculation with reference to permittivity of water as the food. Water 143 as a heating target placed on the left and water 144 as a heating target placed on the right each have permittivity of 76.7, a dielectric loss tangent of 0.16, and a columnar shape with 100 mL in volume, 25 mm in radius, and 51.3 mm in height. FIG. 13A depicts electric field intensity distribution in a case where the food is placed in the lower region, and has standing wave distribution slightly polarized to the left. FIG. 13B depicts electric field intensity distribution in a case where the food is placed in the upper region, and has irregular standing wave distribution having considerable antinodes of standing waves also on the right. FIG. 13C is a characteristic graph inclusive of the cases of FIG. 13A and FIG. 13B, with height d of the food plotted on a transverse axis and absorbed electrical energy of the food plotted on an ordinate axis. Left water 143 has characteristic 145, and right water 144 has characteristic 146. Also in this case, characteristic 145 for left water 143 has almost constantly larger absorbed electrical energy. Characteristic 145 and characteristic 146 have larger difference particularly when height d is smaller, and microwaves are concentrated on left water 143 as intended.

FIG. 12C and FIG. 13C are compared to find that, although there is slight difference in effect according to permittivity of food, reflection angle θ122 can be controlled in the both cases when height is small. Investigated is why reflection angle θ122 can be better controlled with small height and can be less controlled with large height. This is relevant to size of a gap between the food and reflection angle control device 138. Specifically, the gap between the food and reflection angle control device 138 is smaller with larger height d. Peripheral microwaves (e.g., microwaves reflected by side wall 110) thus fail to enter the small gap and reach the food, so that microwaves reaching upper wall 108 to be reflected are eventually decreased in absolute quantity. The function of reflection angle control device 138 will thus not be exerted effectively.

Second Exemplary Embodiment

FIG. 14A to FIG. 18 are explanatory views of a microwave heating device according to a second exemplary embodiment of the present invention. The present exemplary embodiment relates to rightward reflection.

Figure 14A:
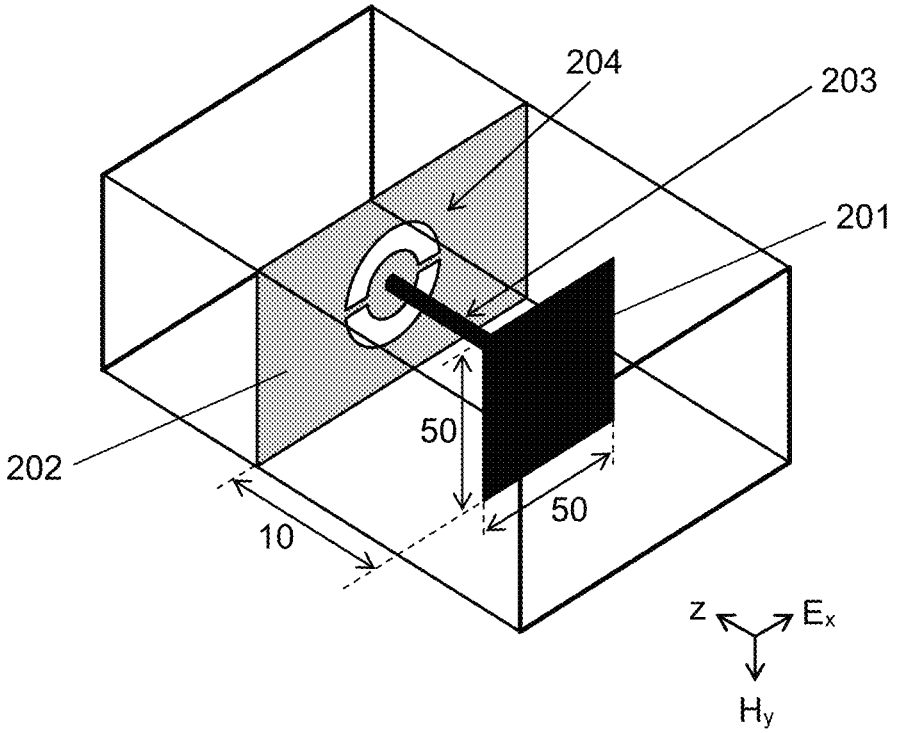
FIG. 14A is a perspective view depicting a configuration of a single conductive patch and a peripheral portion cut out of a microwave heating device according to a second exemplary embodiment of the present invention.
Figure 14B:
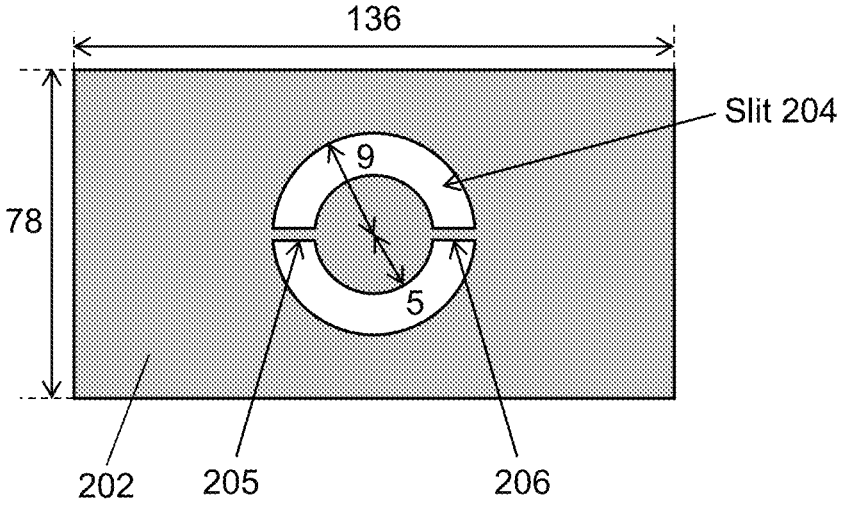
FIG. 14B is a front view of a ground as an opposing surface of the removed conductive patch in the microwave heating device according to the second exemplary embodiment of the present invention.

FIG. 14A and FIG. 14B depict only one conductive patch 201 and a peripheral portion (hereinafter, called a unit cell), cut out of a reflection angle control device, as a configuration of a model for electromagnetic field simulation. FIG. 14A is a perspective view of only one conductive patch 201 and the peripheral portion thus cut out, whereas FIG. 14B is a front view of ground 202 as an opposing surface of removed conductive patch 201. Conductive patch 201 electrically short-circuits to ground 202 through conductive via hole 203 and is held. When ground 202 has annular slit 204 provided with two variable capacitances 205, 206, there is found change in reflection phase according to the capacitances.

Figure 15A:
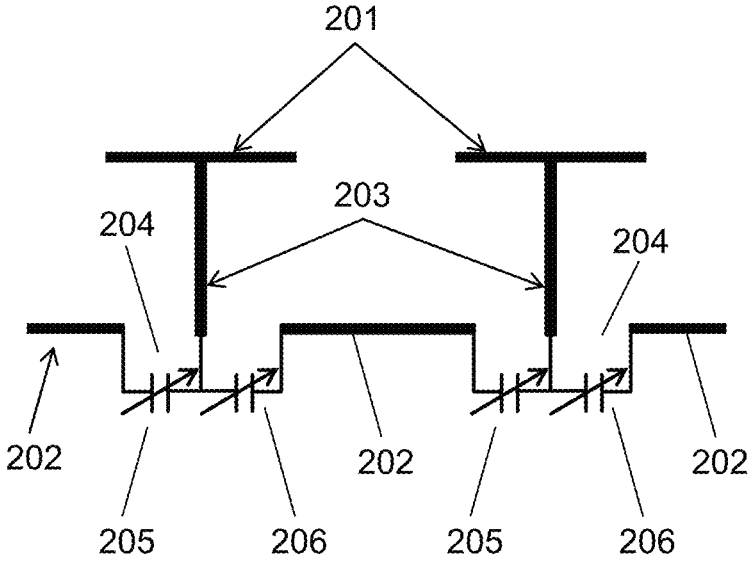
FIG. 15A is a schematic sectional view of a main part of the microwave heating device according to the second exemplary embodiment of the present invention.
Figure 15B:
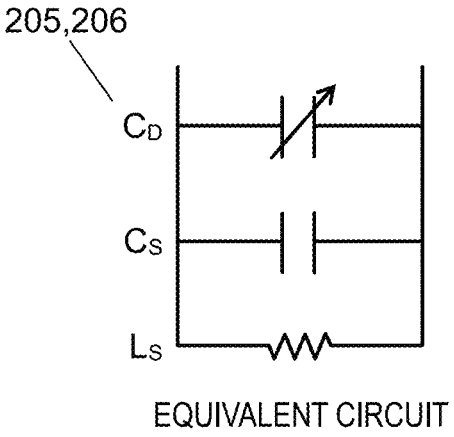
FIG. 15B is an equivalent circuit diagram of a variable capacitance diode achieving variable capacitance 205, 206.

FIG. 15A is a schematic sectional view of conductive patches 201 and peripheral portions, and FIG. 15B depicts an equivalent circuit of a variable capacitance diode achieving variable capacitance 205, 206. Specifically, by adopting a varactor diode or the like, which is known as having a less capacitance value with larger reverse bias voltage, the reverse bias voltage can be controlled to achieve control of capacitance values of variable capacitances 205, 206.

Figure 16:
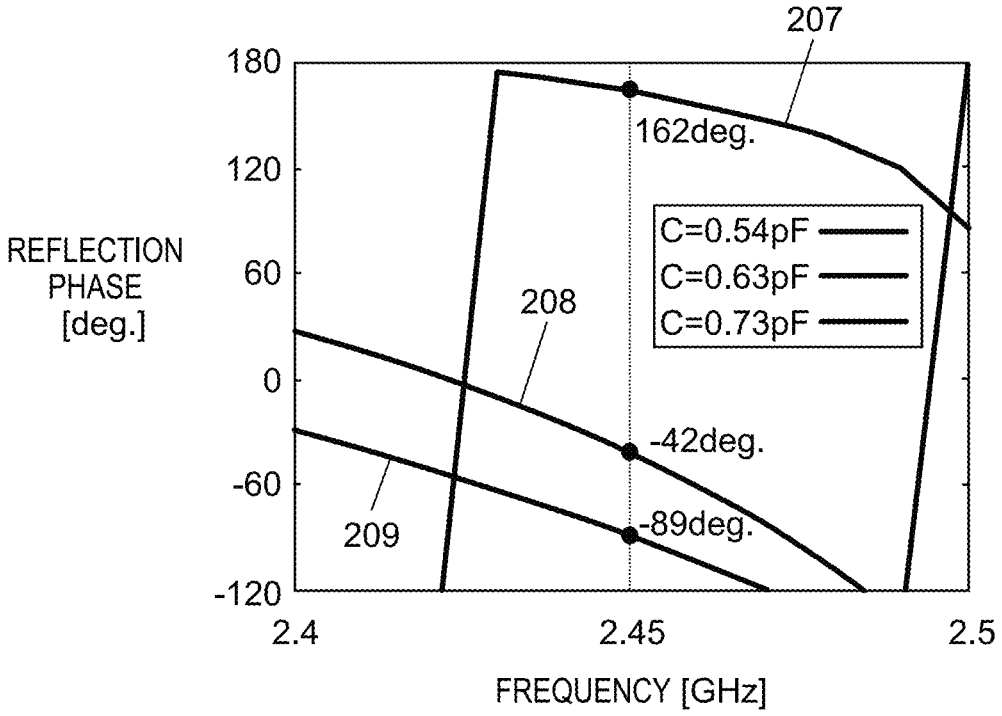
FIG. 16 is a characteristic graph of relation between a frequency and a reflection phase of the microwave heating device according to the second exemplary embodiment of the present invention.

FIG. 16 is a characteristic graph of relation between a frequency on a transverse axis and a reflection phase on an ordinate axis, with capacitance values of the pair of variable capacitances as parameters. When the capacitance value is changed to 0.45 pF (data 207), 0.63 pF (data 208), and 0.73 pF (data 209), the reflection phase has 162 degrees, −42 degrees, and −89 degees, respectively. The reflection phase can thus be changed dynamically in accordance with the capacitance value. It is thus found that variable capacitance control achieves a desired reflection phase.

Figure 17A:
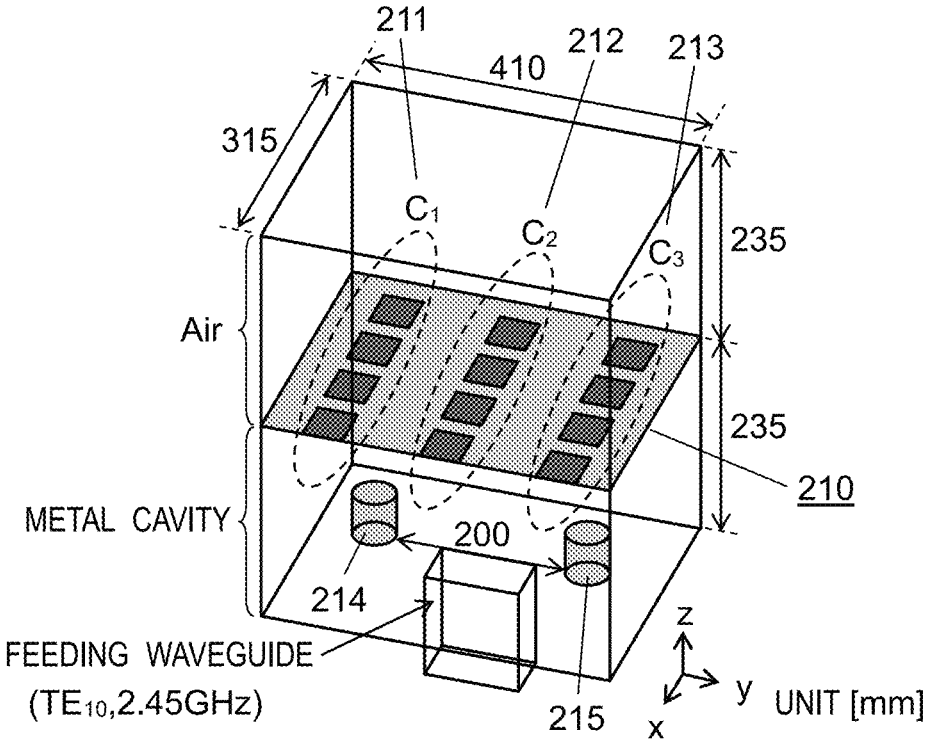
FIG. 17A is a perspective view of the microwave heating device according to the second exemplary embodiment of the present invention.
Figure 17B:
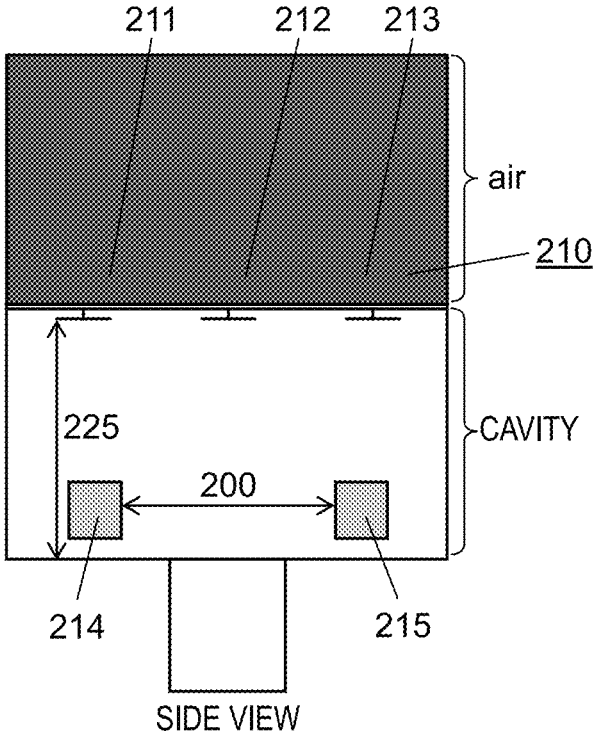
FIG. 17B is a sectional view from a front of the microwave heating device according to the second exemplary embodiment of the present invention.

FIG. 17A and FIG. 17B depict a configuration of reflection angle control device 210 including a plurality of the unit cells in FIG. 14A and FIG. 14B arrayed on a top panel in the cabinet of the microwave oven. FIG. 17A is a perspective view of the microwave heating device according to the present exemplary embodiment, and FIG. 17B is a sectional view from a front of the microwave heating device according to the present exemplary embodiment. The unit cells (including large conductive patches depicted, and small slits and variable capacitances not depicted) are arrayed to have three unit cells aligned in a left-right direction and four unit cells aligned in a front-rear direction when viewed from a front. According to the present exemplary embodiment, change in variable capacitance value is available in the left-right direction (variable capacitance 211 corresponding to variable capacitance C1, variable capacitance 212 corresponding to variable capacitance C2, and variable capacitance 213 corresponding to variable capacitance C3), while the variable capacitances equal in capacitance value are aligned in the front-rear direction.

Figure 18:
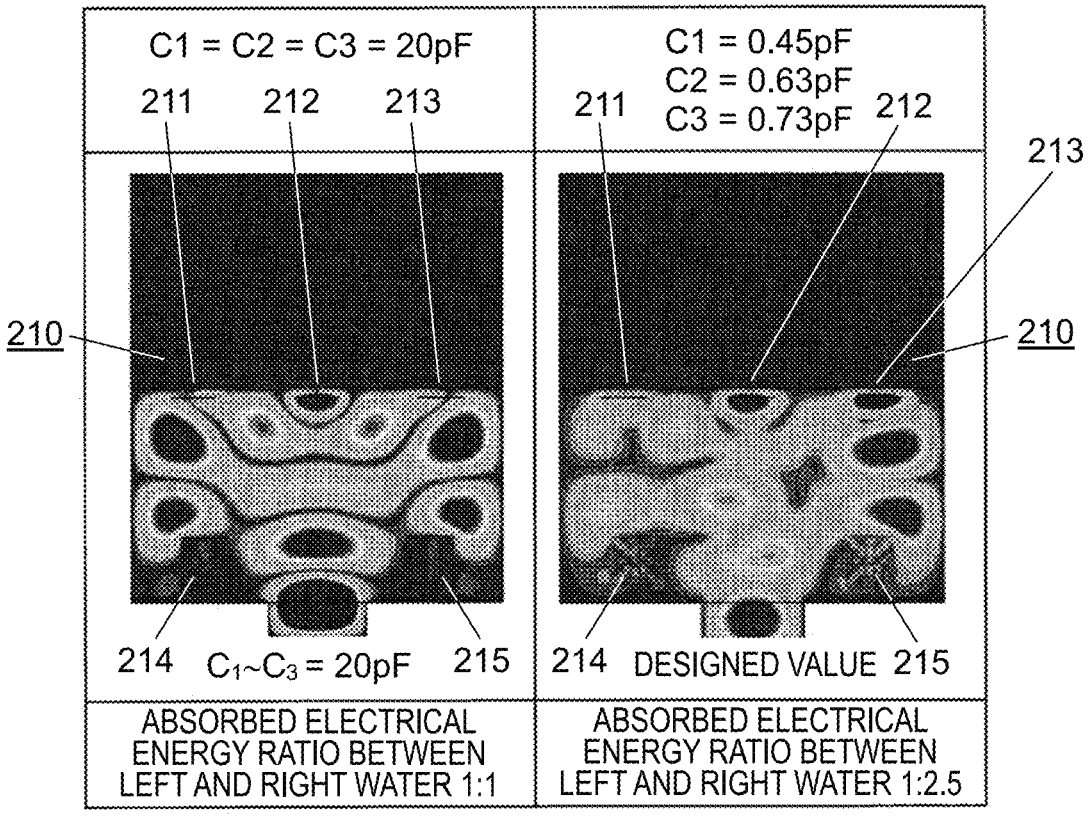
FIG. 18 is a contour diagram of electric field intensity distribution by magnetic field simulation of the microwave heating device according to the second exemplary embodiment of the present invention.

FIG. 18 is a contour diagram of electric field distribution in the cabinet as a result of simulation according to the configuration depicted in FIG. 17A and FIG. 17B. FIG. 18 has a chart including a left portion with all the variable capacitances having equal values (variable capacitance C1=variable capacitance C2=variable capacitance C3=20 pF), and a left portion with capacitance values gradually increased from the left to the right (variable capacitance C1=0.45 pF, variable capacitance C2=0.63 pH, and variable capacitance C3=0.73 pF) to achieve gradual decrease in reflection phase. The left portion of the chart thus has electric field distribution bilaterally symmetric in the cabinet, and left and right water 214, 215 are substantially equal in absorbed electrical energy to achieve an absorbed electrical energy ratio of 1:1. Meanwhile, the right portion of the chart has electric field distribution bilaterally asymmetric in the cabinet (weak on the left and strong on the right), and left and right water 214, 215 have an absorbed electrical energy ratio of 1:2.5 with larger absorbed electrical energy of the right water. The variable capacitances are disposed to gradually increase from the left to the right, to achieve gradual decrease in reflection phase and deviation in reflection angle to an array direction (a direction of decreasing reflection phases).

Provision of slit 204 may cause external leakage of microwaves from slit 204. As FIG. 18 depicts a leakage electric field above the slit (i.e., above reflection angle control device 210), there is substantially no leakage. Leakage from the slit will be safely prevented by providing a leakage preventive choke structure or a microwave absorber like ferrite around the slit.

Third Exemplary Embodiment

Figure 19:
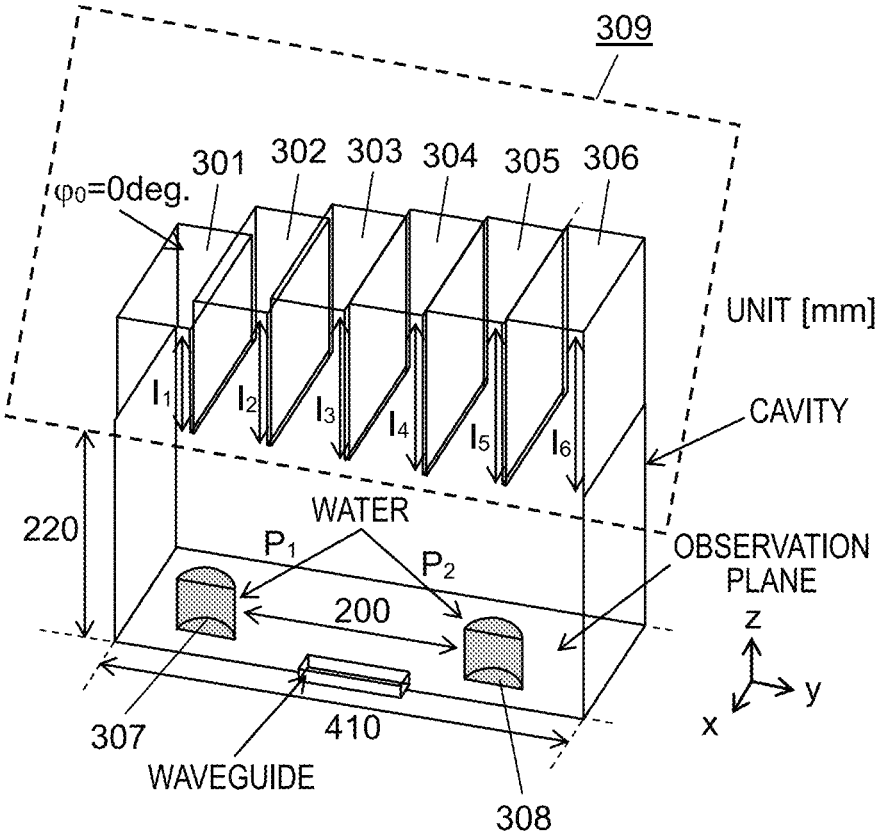
FIG. 19 is a sectional perspective view of a microwave heating device according to a third exemplary embodiment of the present invention.
Figure 20:
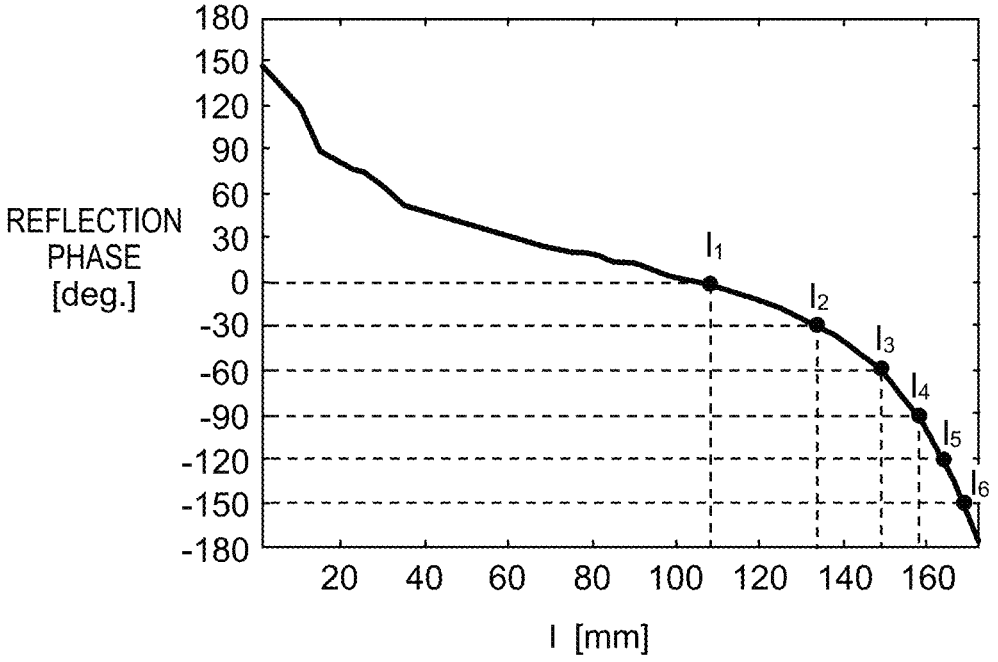
FIG. 20 is a characteristic graph of relation between length of a wave guide and a reflection phase of the microwave heating device according to the third exemplary embodiment of the present invention.
Figure 21:
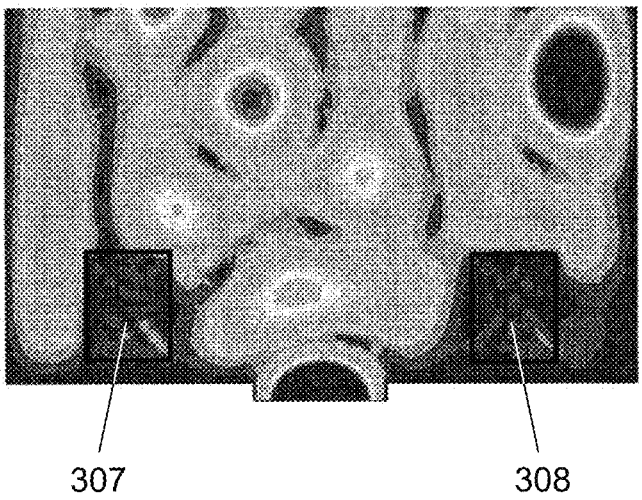
FIG. 21 is a contour diagram of electric field intensity distribution by magnetic field simulation of the microwave heating device according to the third exemplary embodiment of the present invention.

FIG. 19 to FIG. 21 are explanatory views of a microwave heating device according to a third exemplary embodiment of the present invention. The present exemplary embodiment relates to rightward reflection of microwaves.

FIG. 19 is a sectional perspective view of the microwave heating device according to the third exemplary embodiment of the present invention, exemplifying a case where six waveguides each of which has a closed terminal end are aligned for change in reflection phase according to positioning of the top panel of the microwave oven. FIG. 19 depicts waveguide 301 having length L1, waveguide 302 having length L2, waveguide 303 having length L3, waveguide 304 having length L4, waveguide 305 having length L5, and waveguide 306 having length L6 aligned from the left in the mentioned order. The microwave heating device depicted in FIG. 19 is a simulation model symmetric in the front-rear direction. FIG. 19 accordingly depicts only a rear half with halved water 307, 308.

FIG. 20 is a characteristic graph of relation between waveguide length on a transverse axis and a reflection phase on an ordinate axis. Waveguides 301 to 306 are configured to have reflection phases gradually decreased by 30 degrees in this order from the left. Waveguide 301 having length L1=105 mm has a reflection phase of 0 degrees, waveguide 302 having length L2=133 mm has a reflection phase of −30 degrees, and waveguide 303 having length L1=148 mm has a reflection phase of −60 degrees. Waveguide 304 having length L1=157 mm has a reflection phase of −90 degrees, waveguide 305 having length L1=164 mm has a reflection phase of −120 degrees, and waveguide 306 having length L1=169 mm has a reflection phase of −150 degrees.

FIG. 21 is a contour diagram of electric field distribution in the cabinet as a result of simulation according to the configuration relevant to FIG. 20. FIG. 21 does not depict the waveguides disposed in the upper region. FIG. 21 has a portion with a strong electric field in the right region of the cabinet. The waveguides are disposed to gradually be increased in length from the left to the right, to achieve gradual decrease in reflection phase and deviation in reflection angle to the array direction (the direction of decreasing reflection phases). Waveguides 301 to 306 and an opening structure thus provided at the top panel according to the present exemplary embodiment can be regarded as configuring reflection angle control device 309 (see FIG. 19).

Fourth Exemplary Embodiment

Figure 22A:
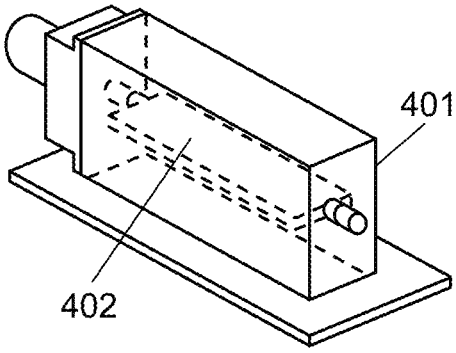
FIG. 22A is a perspective view of a waveguide in a microwave heating device according to a fourth exemplary embodiment of the present invention.
Figure 22B:
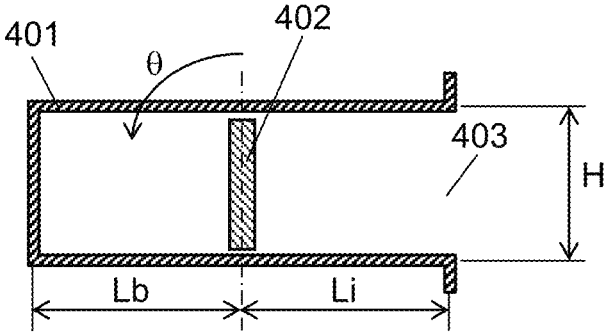
FIG. 22B is a sectional view of the waveguide in the microwave heating device according to the fourth exemplary embodiment of the present invention, the waveguide including a dielectric board disposed substantially in parallel with an open end.
Figure 22C:
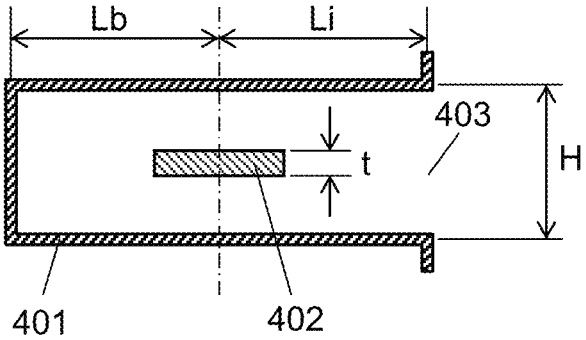
FIG. 22C is a sectional view of the waveguide in the microwave heating device according to the fourth exemplary embodiment of the present invention, the waveguide including the dielectric board disposed substantially perpendicularly to the open end.

FIG. 22A, FIG. 22B, and FIG. 22C are explanatory views of a microwave heating device according to a fourth exemplary embodiment of the present invention. The present exemplary embodiment is achieved by improving the configurations of waveguides 301 to 306 according to the third exemplary embodiment through application of the structure disclosed in JP 4164934 B1. FIG. 22A is a perspective view of a waveguide in the microwave heating device according to the fourth exemplary embodiment of the present invention. FIG. 22B is a sectional view of the waveguide in the microwave heating device according to the fourth exemplary embodiment of the present invention, the waveguide including a dielectric board disposed substantially in parallel with an open end. FIG. 22C is a sectional view of the waveguide in the microwave heating device according to the fourth exemplary embodiment of the present invention, the waveguide including the dielectric board disposed substantially perpendicularly to the open end. Waveguide 401 contains dielectric board 402 controlled to rotate, and has open end 403 having a reflection phase controlled in accordance with the angle of dielectric board 402. Appropriately selected are a shape of waveguide 401, a material (relative permittivity) for and a shape of dielectric board 402, a position of dielectric board 402 attached to waveguide 401 (a rotation center position), and the like. The reflection phase at open end 403 can have −180 degrees when dielectric board 402 has a wide surface substantially parallel to open end 403 as depicted in FIG. 22B. The reflection phase at open end 403 can have 0 degrees when the wide surface of dielectric board 402 is substantially perpendicular to open end 403 as depicted in FIG. 22C.

The present exemplary embodiment thus achieves effects similar to the effects of the third exemplary embodiment not by changing the actual length of waveguide 401 but by changing only the angle of dielectric board 402 in each of aligned waveguides 401 being equal in length.

Fifth Exemplary Embodiment

Figure 23A:
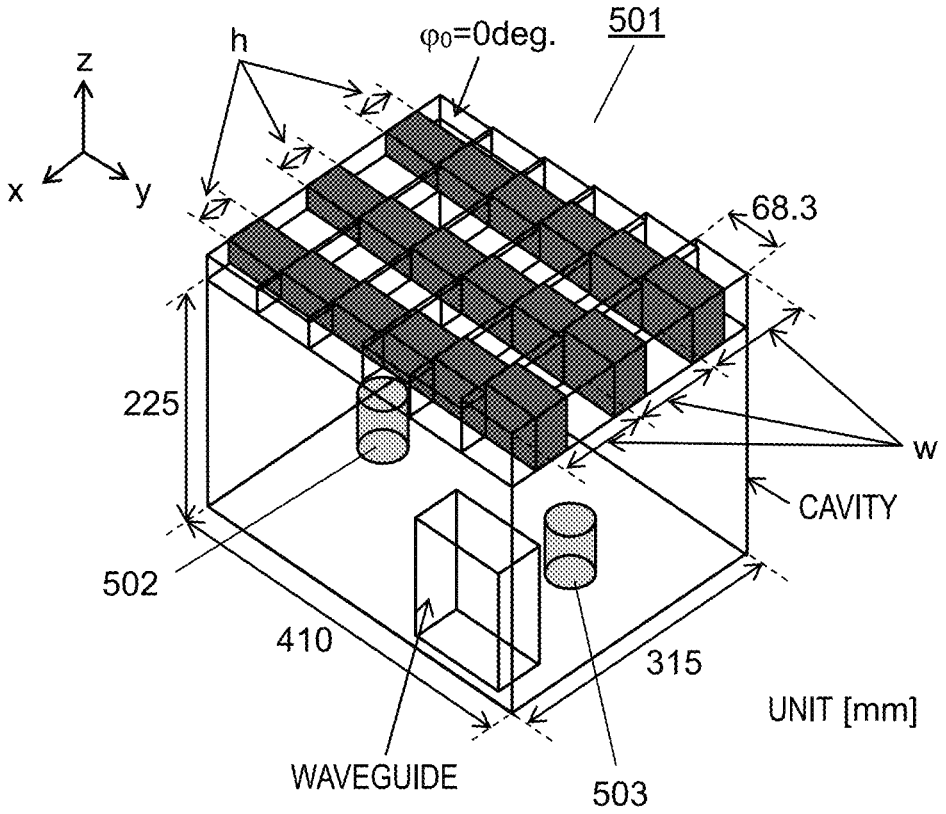
FIG. 23A is a perspective view of a microwave heating device according to a fifth exemplary embodiment of the present invention.
Figure 23B:
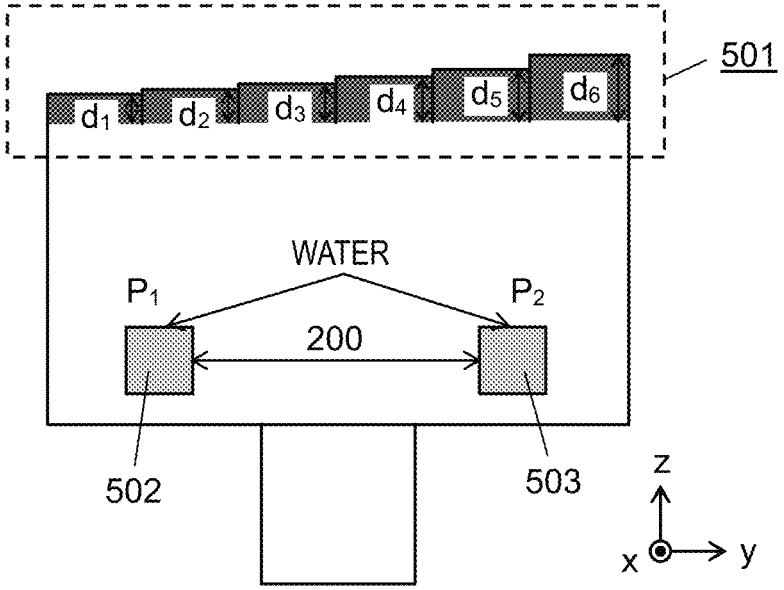
FIG. 23B is a sectional view from a front of the microwave heating device according to the fifth exemplary embodiment of the present invention.
Figure 24:
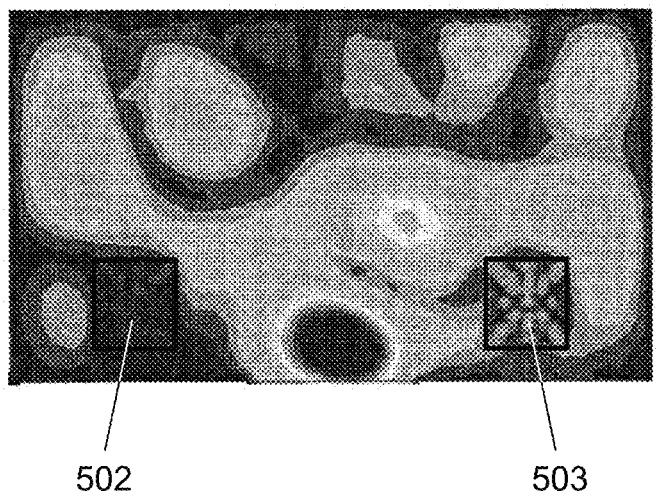
FIG. 24 is a contour diagram of electric field intensity distribution by magnetic field simulation of the microwave heating device according to the fifth exemplary embodiment of the present invention.
Figure 25:
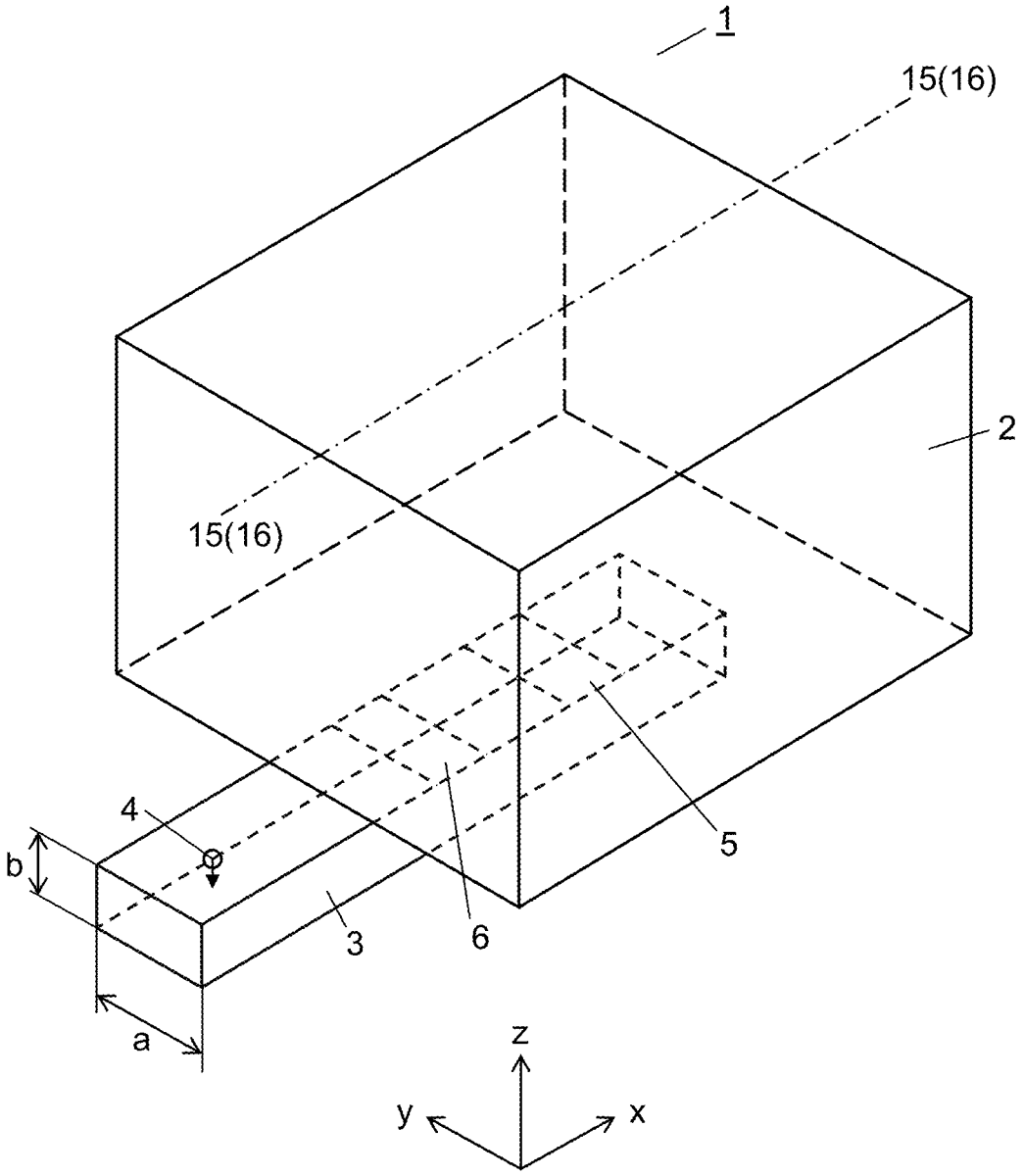
FIG. 25 is a perspective view of a microwave oven as an electromagnetic field simulation model for exemplification of conventional standing wave distribution.
Figure 26:
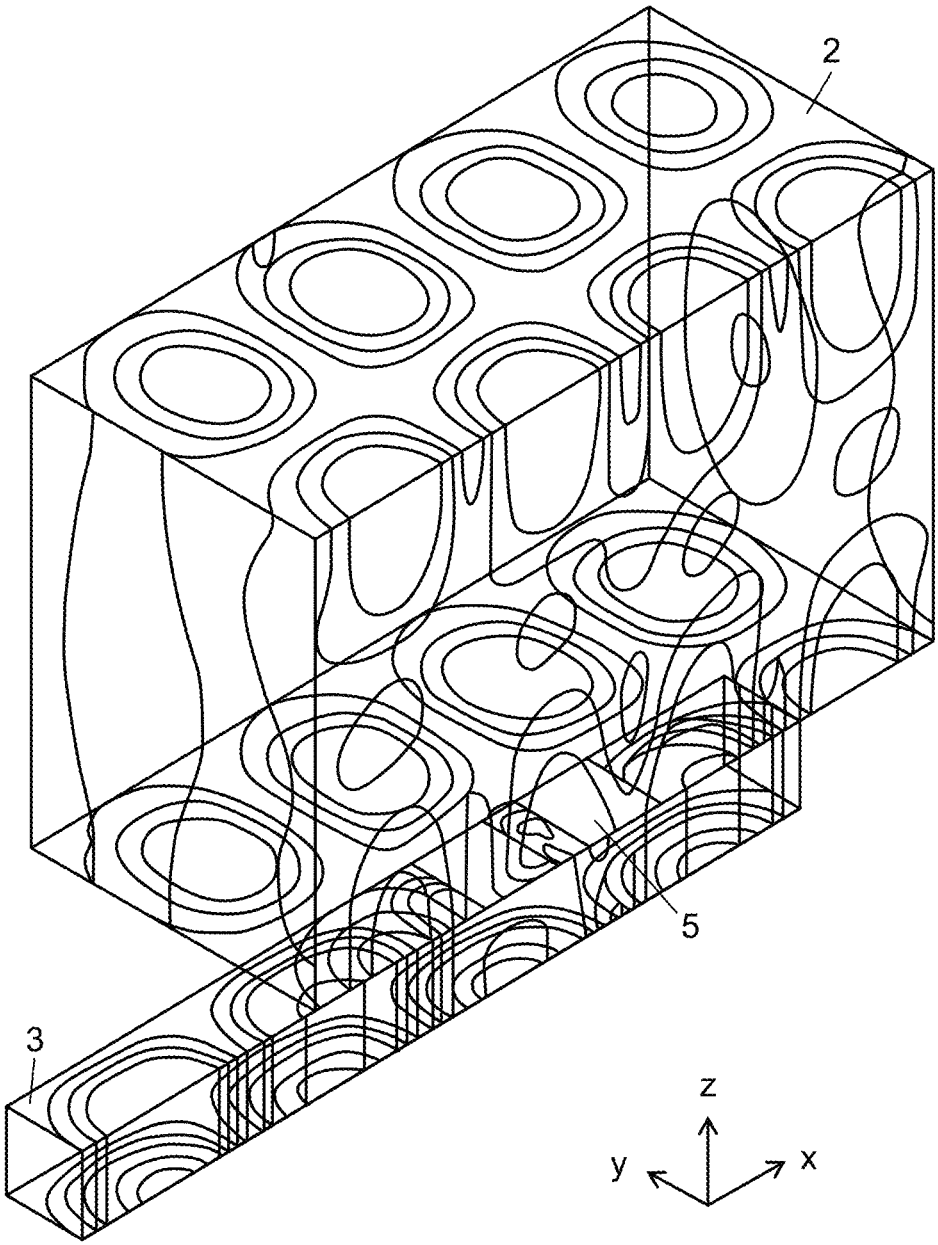
FIG. 26 is an electric field intensity contour map of electromagnetic field simulation for exemplification of conventional standing wave distribution.
Figure 27:
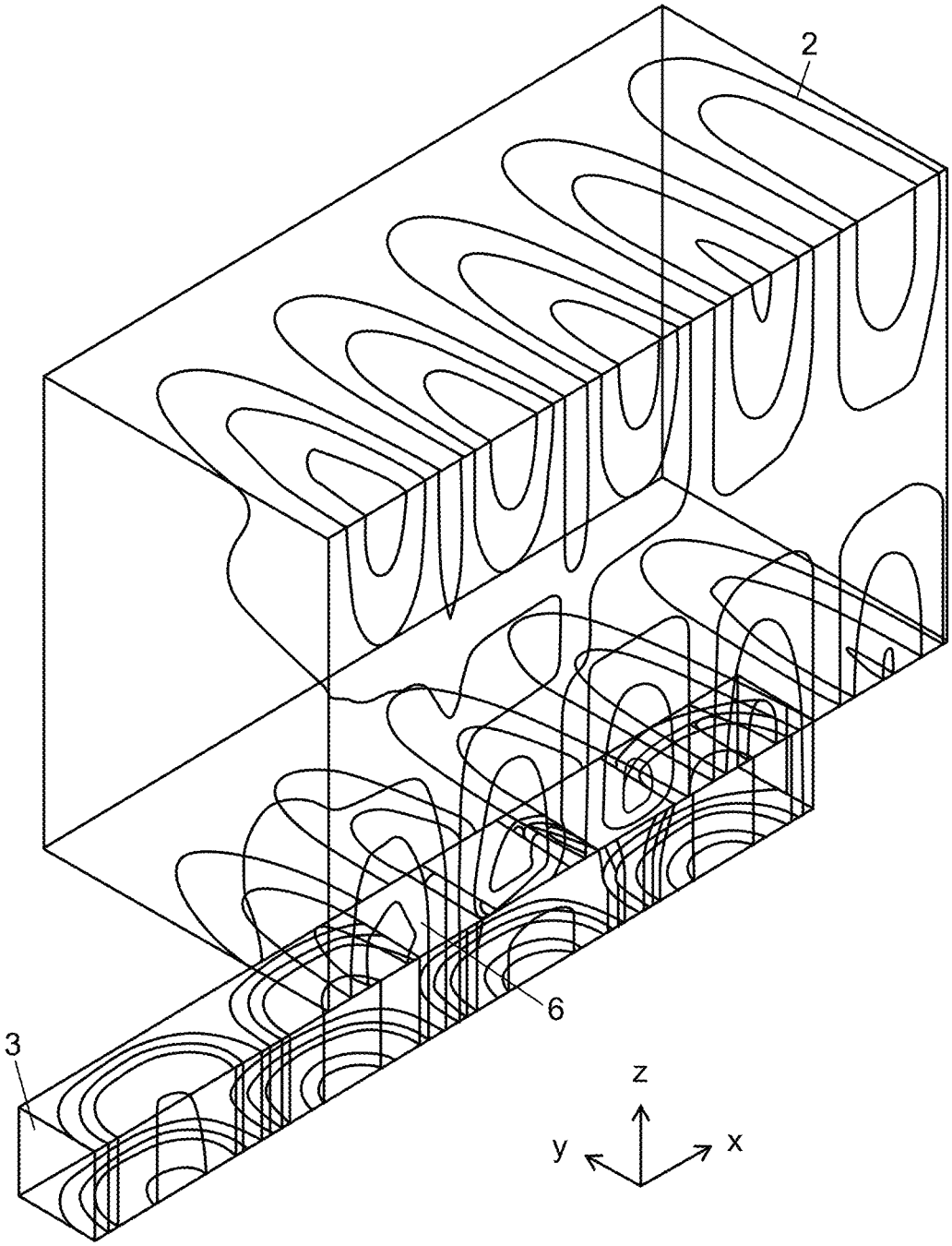
FIG. 27 is another electric field intensity contour map of electromagnetic field simulation for exemplification of conventional standing wave distribution.

FIG. 23A, FIG. 23B, and FIG. 24 are explanatory views of a microwave heating device according to a fifth exemplary embodiment of the present invention. The present exemplary embodiment relates to rightward reflection of microwaves.

FIG. 23A and FIG. 23B depict a configuration of reflection angle control device 501 disposed at the top panel in the cabinet of the microwave oven and having a so-called corrugated structure including a plurality of recesses and a plurality of projections arrayed periodically. Specifically, FIG. 23A is a perspective view of the microwave heating device according to the fifth exemplary embodiment of the present invention, whereas FIG. 23B is a sectional view from a front of the microwave heating device according to the fifth exemplary embodiment of the present invention. The corrugated structure requires a plurality of periodic configurations, but achieves reduction in length as compared with the waveguides according to the third exemplary embodiment.

FIG. 24 is a contour diagram of electric field distribution in the cabinet as a result of simulation according to the configuration depicted in FIG. 23A and FIG. 23B. FIG. 24 does not depict the corrugated structure in the upper region. FIG. 24 depicts the electric field in the cabinet uneven but unknown whether or not being polarized. Left and right water 502, 503 actually have an absorbed electrical energy ratio as large as 1:10. This can be found in FIG. 24 not by observing only the electric field in the cabinet but by observing the electric field in each of left and right water 502, 503. Right water 503 is obviously brighter in color than left water 502 and thus has a stronger electric field. Accordingly, the corrugated structure gradually increased in depth from the left to the right will achieve gradual decrease in reflection phase and deviation in reflection angle to the array direction (the direction of decreasing reflection phases).

As described above, microwave heating device 101 according to the present exemplary embodiment includes heating chamber 103, and microwave radiation device 104 configured to radiate a microwave into heating chamber 103 to heat food 102 as a heating target. Heating chamber 103 has upper wall 108 configuring at least part of walls of heating chamber 103 and having reflection angle control device 118, 137, 138 configured to control reflection angle θ122 of the microwave to control standing wave distribution in heating chamber 103. Reflection angle control device 118, 137, 138 thus controls the reflection angle of the microwave radiated from microwave radiation device 104 and not absorbed directly into food 102 as the heating target but reflected by the wall. The standing wave distribution in heating chamber 103 can thus be controlled to be different (as depicted in FIG. 11B, FIG. 11C, FIG. 12A, FIG. 12B, FIG. 13A, or FIG. 13B) from ordinary distribution (depicted in FIG. 11A), to achieve improvement in local heating performance.

In microwave heating device 101 according to the present exemplary embodiment, reflection angle control device 118, 137, 138 includes a plurality of arrayed conductive patches 120, and is configured to control reflection angle θ122 (e.g., to 20°) in accordance with difference in reflection phase (e.g., 30°) of adjacent conductive patches 120. Even when microwaves have aligned wave surfaces before reaching adjacent conductive patches 120, reflected waves have wave surfaces inclined by the difference in reflection phase, to achieve reliable inclination of reflection angle θ122 (e.g., 20°).

In microwave heating device 101 according to the present exemplary embodiment, reflection angle control device 118, 137, 138 includes a plurality of conductive patches 120 arrayed such that adjacent conductive patches 120 are gradually decreased in reflection phase (e.g., 90°, 60°, 30°, 0°, −30°, . . . as indicated in FIG. 8). Any range of arrayed conductive patches 120 can thus secure the difference in reflection phase (e.g., 30°) to achieve inclination of reflection angle θ122 (e.g., at 20°) in a wide range (e.g., the entire walls).

In microwave heating device 101 according to the present exemplary embodiment, reflection angle control device 118, 137, 138 includes a plurality of conductive patches 120 arrayed such that the adjacent conductive patches are different in size (e.g., w1, w2, . . . as depicted in FIG. 9). The sizes of the conductive patches cause difference in reflection phase as exemplarily indicated in FIG. 8, to facilitate provision of difference (e.g., 30°) in reflection phase between the plurality of conductive patches. The plurality of conductive patches 120 are gradually increased in size (e.g., squares having sides w of 13.2 mm, 16.6 mm, . . . , and 28.4 mm) to achieve gradual difference in reflection phase (e.g., 90°, 60°, 30°, . . . ). The reflection phases are thus randomly disposed to be prevented from canceling each other, and the wave surfaces of the reflected waves can be aligned in a certain direction, to achieve more reliable inclination of reflection angle θ122 (e.g., 20°).

In microwave heating device 101 according to the present exemplary embodiment, adjacent conductive patches 120 are substantially constantly different in reflection phase (e.g., 30°). This achieves perfect alignment of the wave surfaces of the reflected waves to a certain direction, to enable most reliable inclination of the reflection angle.

Additionally described below is a case where food includes combined articles such as hamburg steak and fresh vegetable particularly requiring local heating performance of the microwave oven. Such food combination ideally requires the hamburg steak to be locally heated and the fresh vegetable not to be heated.

Reflection angle control device 118 disposed on upper wall 108 as in the present exemplary embodiment is desirably configured to cause reflection toward the hamburg steak expected to be heated and prevent reflection toward the fresh vegetable not expected to be heated. The reflection phases are thus preferred to gradually be decreased from the fresh vegetable toward the hamburg steak (from the right to the left in FIG. 2). Conductive patches 120 are thus preferred to gradually be increased in size. It is, however, unknown which one of the hamburg steak and the fresh vegetable is placed on the right if there is normally no specification. It is thus preferred to additionally specify placement. For example, placing table 107 can preliminary have a marking at a position to be provided with the fresh vegetable (in the right region in FIG. 2). Placing table 107 can be easily provided with printed letters such as "fresh vegetable", "cool", or "unheated region". When a user places the fresh vegetable at the marking, local heating performance for the hamburg steak is improved while the fresh vegetable is prevented from being heated. The above exemplifies the case where the fresh vegetable is placed on the right. The fresh vegetable can alternatively be placed on the left when arrayed conductive patches 120 are inverted bilaterally.

Assume another case where a reflection angle control device is provided on a side wall. Food is placed rather vertically low in the heating chamber, so that the following idea will be applicable. The reflection angle control device provided on the side wall close to the hamburg steak (a left side wall in FIG. 2) will be preferred to cause downward reflection to direct reflected waves toward the hamburg steak at the low position. The reflection phases are thus preferred to gradually be decreased from the top to the bottom to achieve downward reflection. Conductive patches 120 are accordingly preferred to gradually be increased in size from the top to the bottom. In contrast, the reflection angle control device provided on the side wall close to the fresh vegetable (a right side wall in FIG. 2) will be preferred to cause upward reflection to prevent reflected waves from being directed toward the fresh vegetable at the low position. The reflection phases are thus preferred to gradually be decreased from the bottom to the top to achieve upward reflection. Conductive patches 120 are accordingly preferred to gradually be increased in size from the bottom to the top. The left side wall and the right side wall are thus preferred to have vertically inverted arrays. Applying this idea to a rear side wall, the rear side wall will be preferred to be separated into a left half and a right half. The left half of the rear side wall can have an array similar to the array on the left side wall, whereas the right half of the rear side wall can have an array similar to the array on the right side wall. The above also exemplifies the case where the fresh vegetable is placed on the right. The fresh vegetable can alternatively be placed on the left when arrayed conductive patches 120 are inverted bilaterally.

Directions of a microwave radiated into the heating chamber and the reflection angle have important relation. reflection angle control device 118, 137, 138 is disposed on the upper wall when microwaves are incident from the bottom wall as in the present exemplary embodiment. It will be most effective to dispose the reflection angle control device on a surface opposite to the incident surface. In a case where reflection angle control device 118 controls reflected waves and the antenna or the like controls also incident waves, incident wave control and reflected wave control will achieve multiplier effects. In the configuration of FIG. 2, antenna 106 having directivity is controlled in direction to allow microwaves radiated from antenna 106 (can also be called incident waves or direct waves) to be directed toward hamburg steak 111 and not to be directed toward fresh vegetable 112, in other words, to achieve strong directivity toward hamburg steak 111 (the left region in FIG. 2). The reflected waves are also preferred to be controlled to be reflected by the upper wall toward hamburg steak 111 as describe above. In other words, incidence (leftward) of the microwaves and reflection (leftward) by the reflection angle control device will be desirably aligned in direction.

In summary, the reflection phases are preferred to gradually be decreased toward the direction of incident microwaves into the heating chamber (from the right to the left in FIG. 2). Conductive patches 120 are thus preferred to gradually be increased in size. The bottom wall can be partially provided with a reflection angle control device in a region not provided with the antenna. Also in this case, incidence (leftward) of the microwaves and reflection (leftward) by the reflection angle control device will be desirably aligned in direction. The above also exemplifies the case where the fresh vegetable is placed on the right. The fresh vegetable can alternatively be placed on the left when arrayed conductive patches 120 are inverted bilaterally.

The wall to be provided with the reflection angle control device can be selected freely in accordance with a purpose.

The reflection angle control device can be provided only on the single surface as in the present exemplary embodiment, or can alternatively be provided on two or more surfaces. The reflection angle control device can cover the entire wall as in the present exemplary embodiment, or can be provided only partially on the wall.

The reflection angle control device according to the present exemplary embodiment includes the wall and the dielectric layer connected to the wall, but can alternatively be configured differently. For example, the reflection angle control device can include a double-sided board. The double-sided board can have a front surface provided with etched conductive patches, and a rear surface functioning as a solid ground surface to be fixed to the wall. The conductive patches formed by etching the board will achieve improved accuracy in size.

There is other food, in addition to fresh vegetable, which is not preferred to be heated by a microwave oven. The food may also include cold dessert placed on the plate, or a lunch box of various dishes may contain pickled vegetable or a vinegared dish. The improvement in local heating performance will prevent heating such food.

As described above, the microwave heating device according to the present invention includes a heating chamber, a microwave radiation device configured to radiate a microwave into the heating chamber to heat a heating target, and a reflection angle control device provided at least part of a wall of the heating chamber and configured to control a reflection angle of the microwave to control standing wave distribution in the heating chamber.

This configuration causes the reflection angle control device to control the reflection angle of the microwave when the microwave radiated from the microwave radiation device is not directly absorbed into the heating target but is reflected by the wall. The standing wave distribution in the heating chamber can thus be controlled to be different from ordinary distribution for improvement in local heating performance.

The reflection angle control device according to the present invention can alternatively be configured to control the reflection angle in accordance with difference in reflection phase depending on a reflection position.

Any range of the arrayed conductive patches can thus secure the difference in reflection phase to achieve inclination of the reflection angle in the wide range.

The reflection angle control device according to the present invention can alternatively have the reflection phases arrayed to gradually be decreased, to achieve deviation in reflection angle to the array direction.

Any range of the arrayed conductive patches can thus secure the difference in reflection phase to achieve inclination of the reflection angle in the wide range.

The reflection angle control device according to the present invention can alternatively include a plurality of conductive patches arrayed to gradually be increased in size, to achieve gradual decrease in reflection phase.

Any range of the arrayed conductive patches can thus secure the difference in reflection phase to achieve inclination of the reflection angle in the wide range.

The reflection angle control device according to the present invention can alternatively include a plurality of conductive patches and variable capacitances disposed to oppose the conductive patches and arrayed to gradually be increased, to achieve gradual decrease in reflection phase.

This configuration achieves gradual decrease in reflection phase and deviation in reflection angle to the array direction (the direction of decreasing reflection phases), to achieve inclination of the reflection angle in a wide range.

The reflection angle control device according to the present invention can alternatively include a plurality of waveguides arrayed to gradually be increased in length.

This configuration achieves gradual decrease in reflection phase and deviation in reflection angle to the array direction (the direction of decreasing reflection phases), to achieve inclination of the reflection angle in a wide range.

The reflection angle control device according to the present invention can alternatively include a plurality of corrugated structures arrayed to gradually be increased in depth.

This configuration achieves gradual decrease in reflection phase and deviation in reflection angle to the array direction (the direction of decreasing reflection phases), to achieve inclination of the reflection angle in a wide range.

INDUSTRIAL APPLICABILITY

As described above, the microwave heating device according to the present invention is configured to control standing wave distribution in the heating chamber to be different from ordinary distribution to improve local heating performance, and is effectively applicable to a microwave heating device configured to heat or sterilize food.

REFERENCE MARKS IN THE DRAWINGS

1, 101: microwave oven (microwave heating device)
2, 103: heating chamber
3, 105, 301, 302, 303, 304, 305, 306, 401: waveguide
102: food (heating target)
104: magnetron (microwave radiation device)
105*a*: opening
108: upper wall (wall)
111: hamburg steak (heating target)
112: fresh vegetable (heating target)
118, 137, 138, 210, 309, 501: reflection angle control device
120, 201: conductive patch
122: reflection angle θ
139, 140: beef (heating target)
143, 144, 214, 215, 307, 308, 502, 503: water (heating target)
202: ground (opposing surface)
205, 206, 211, 212, 213: variable capacitance

The invention claimed is:

1. A microwave heating device comprising a heating chamber, a microwave radiation device configured to radiate a microwave into the heating chamber to heat a heating target, and a reflection angle control device provided at least part of a wall of the heating chamber and configured to control a reflection angle of the microwave to control standing wave distribution in the heating chamber, wherein the reflection angle control device is configured to control the reflection angle such that the standing wave distribution in the heating chamber is polarized in accordance with difference in reflection phase depending on a reflecting position.

2. The microwave heating device according to claim 1, wherein the reflection angle control device has reflection phases arrayed to gradually be decreased, to deviate the reflection angle in a direction of the decrease.

3. The microwave heating device according to claim 2, wherein the reflection angle control device includes a plurality of conductive patches arrayed to gradually be increased in size to gradually decrease the reflection phases.

4. The microwave heating device according to claim 2, wherein the reflection angle control device includes a plurality of conductive patches and variable capacitances opposing the conductive patches, and the variable capacitances are arrayed to gradually be increased, to gradually decrease the reflection phases.

5. The microwave heating device according to claim 2, wherein the reflection angle control device includes a plurality of waveguides, and the plurality of waveguides is arrayed to gradually be increased in length.

6. The microwave heating device according to claim 2, wherein the reflection angle control device includes a plurality of corrugated structures, and the plurality of corrugated structures is arrayed to gradually be increased in depth.

* * * * *